US012349856B2

(12) United States Patent
Sumiyoshi

(10) Patent No.: US 12,349,856 B2
(45) Date of Patent: Jul. 8, 2025

(54) ROBOTIC DUST COLLECTOR

(71) Applicant: MAKITA CORPORATION, Anjo (JP)

(72) Inventor: Hirotaka Sumiyoshi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 371 days.

(21) Appl. No.: 17/793,810

(22) PCT Filed: Nov. 5, 2020

(86) PCT No.: PCT/JP2020/041371
§ 371 (c)(1),
(2) Date: Jul. 19, 2022

(87) PCT Pub. No.: WO2021/161594
PCT Pub. Date: Aug. 19, 2021

(65) Prior Publication Data

US 2023/0136162 A1 May 4, 2023

(30) Foreign Application Priority Data

Feb. 10, 2020 (JP) ..... 2020-020853

(51) Int. Cl.
*A47L 9/04* (2006.01)

(52) U.S. Cl.
CPC ..... *A47L 9/0494* (2013.01); *A47L 9/0477* (2013.01)

(58) Field of Classification Search
CPC .... A47L 9/0494; A47L 9/0477; A47L 9/2847; A47L 2201/00; A47L 9/28; A47L 9/02; A47L 11/4052; A47L 11/4058
See application file for complete search history.

(56) References Cited

U.S. PATENT DOCUMENTS

2005/0076466 A1 4/2005 Yan
2012/0096656 A1 4/2012 Jung et al.
(Continued)

FOREIGN PATENT DOCUMENTS

CN 102525351 A * 7/2012 ..... A47L 11/20
CN 103565373 A 2/2014
(Continued)

OTHER PUBLICATIONS

BO Publication Jul. 4, 2012 retrieved translation from Espacenet: https://worldwide.espacenet.com/patent/search/family/044992568/publication/CN102525351A?q=CN102525351%20A (Year: 2012).*
(Continued)

*Primary Examiner* — Eric J Rosen
*Assistant Examiner* — Christopher Soto
(74) *Attorney, Agent, or Firm* — Oliff PLC

(57) ABSTRACT

A robotic dust collector includes a suction member having a suction inlet and travels on a cleaning target surface. The robotic dust collector includes a guide member, a support part, and a biasing member. The guide member is disposed at the suction inlet and has a blade part facing the cleaning target surface. The support part supports the guide member in such a manner that allows the guide member to pivot about a pivot axis so as to allow the blade part to move in an up-down direction. The biasing member is configured to exert biasing force on at least a part of the blade part.

14 Claims, 17 Drawing Sheets

(56) References Cited

U.S. PATENT DOCUMENTS

| | | | |
|---|---|---|---|
| 2014/0026338 | A1 | 1/2014 | Kim et al. |
| 2017/0188767 | A1 | 7/2017 | Ichikawa et al. |

FOREIGN PATENT DOCUMENTS

| | | | |
|---|---|---|---|
| CN | 104856610 | A | 8/2015 |
| CN | 109589053 | A | 4/2019 |
| CN | 110338701 | A | 10/2019 |
| EP | 2 910 168 | A1 | 8/2015 |
| JP | 3104372 | U | 9/2004 |
| JP | 2012-228619 | A | 11/2012 |
| JP | 2014-023930 | A | 2/2014 |
| JP | 2015-147081 | A | 8/2015 |
| JP | 2015-205091 | A | 11/2015 |
| KR | 101352287 | B1 | 1/2014 |

OTHER PUBLICATIONS

Mar. 12, 2024 Office Action issued in Japanese Patent Application No. 2020-020853.
Feb. 15, 2023 Office Action issued in Chinese Patent Application No. 202080093061.0.
Dec. 28, 2020 International Search Report issued in International Patent Application No. PCT/JP2020/041371.
Dec. 28, 2020 Written Opinion issued in International Patent Application No. PCT/JP2020/041371.
Oct. 3, 2023 Office Action issued in Japanese Patent Application No. 2020-020853.

* cited by examiner

[COMPARABLE EXAMPLE]

[EXAMPLE]

ROBOTIC DUST COLLECTOR

FIELD

The present invention relates to a robotic dust collector.

BACKGROUND

In the technical field pertaining to robotic dust collectors, robotic dust collectors such as one disclosed in Patent Literature 1 are known. The robotic dust collector includes a suction inlet facing a cleaning target surface. The robotic dust collector collects dirt and dust while autonomously traveling on a cleaning target surface.

CITATION LIST

Patent Literature

Patent Literature 1: Korean Registered Patent No. 10-1352287

SUMMARY

Technical Problem

The robotic dust collector has a blade part that guides dirt and dust into the suction inlet. The robotic dust collector cleans cleaning target surfaces with different surface conditions, such as floor or carpet surfaces. Depending on the surface condition of the cleaning target surface, the blade part may come into contact with the cleaning target surface while the robotic dust collector autonomously travels. When the blade part moves in contact with the cleaning target surface, the blade part may vibrate. Noise may occur from the robotic dust collector due to the vibration of the blade part.

The present disclosure has an object to prevent abnormal noise from occurring.

Solution to Problem

According the present disclosure, there is provided a robotic dust collector that includes a suction member having a suction inlet and travels on a cleaning target surface. The robotic dust collector includes a guide member, a support part, and a biasing member. The guide member is disposed at the suction inlet and has a blade part facing the cleaning target surface. The support part supports the guide member in such a manner that allows the guide member to pivot about a pivot axis so as to allow the blade part to move in an up-down direction. The biasing member is configured to exert biasing force on at least a part of the blade part.

Advantageous Effects of Invention

According to the present disclosure, abnormal noise is prevented from occurring.

DESCRIPTION OF EMBODIMENTS

An embodiment of the present disclosure is described below with reference to the drawings. However, the present disclosure is not limited to the embodiment. The components of the embodiment described below can be combined as appropriate. In addition, some of the components may not be used.

In the embodiment, positional relations among components are described using the terms "left", "right", "front", "rear", "up", and "down". These terms refer to relative positions or directions with respect to the center of a robotic dust collector 1.

Robotic Dust Collector

Figure 1:
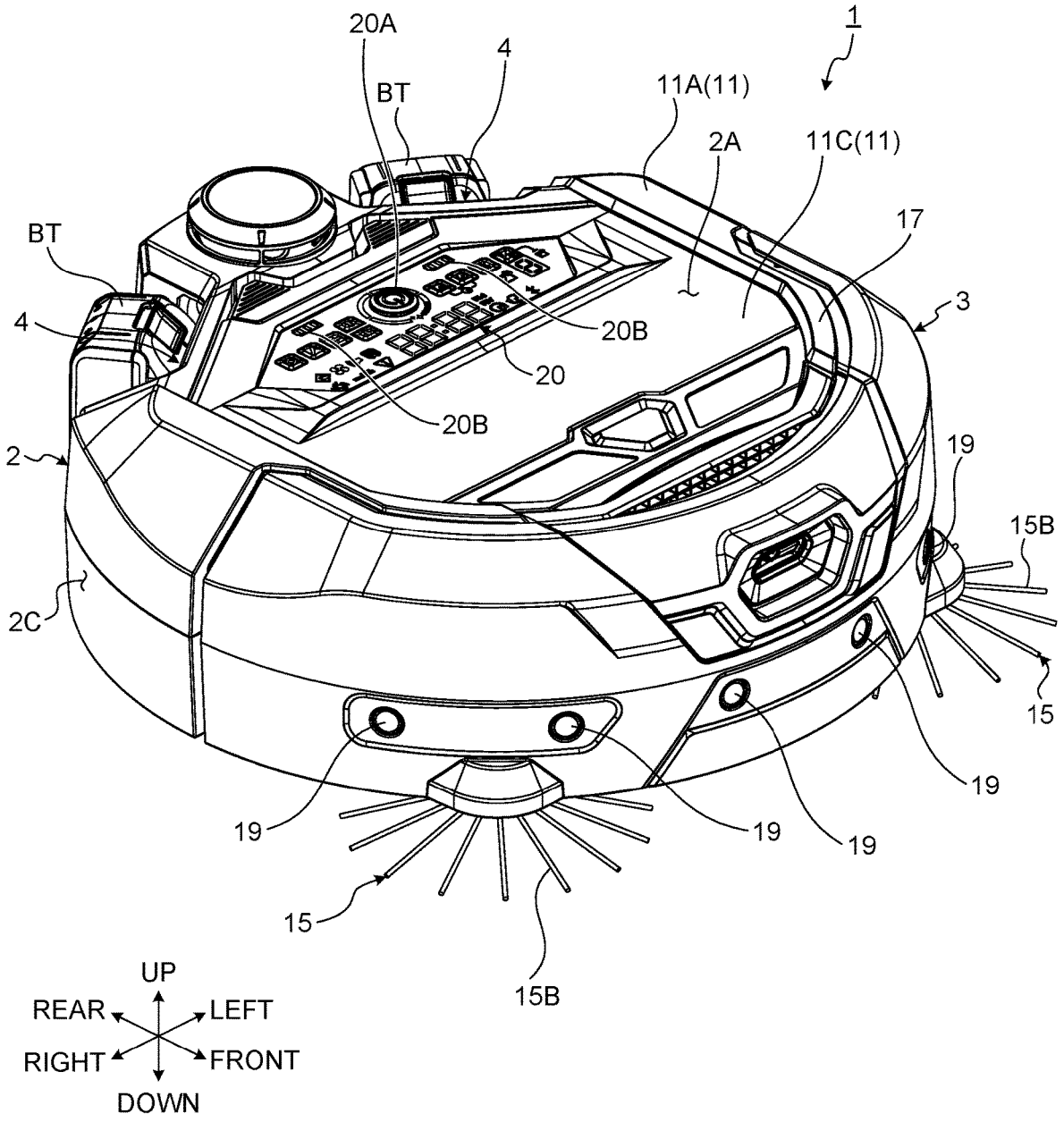
FIG. 1 is a perspective view of a robotic dust collector according to an embodiment.
Figure 2:
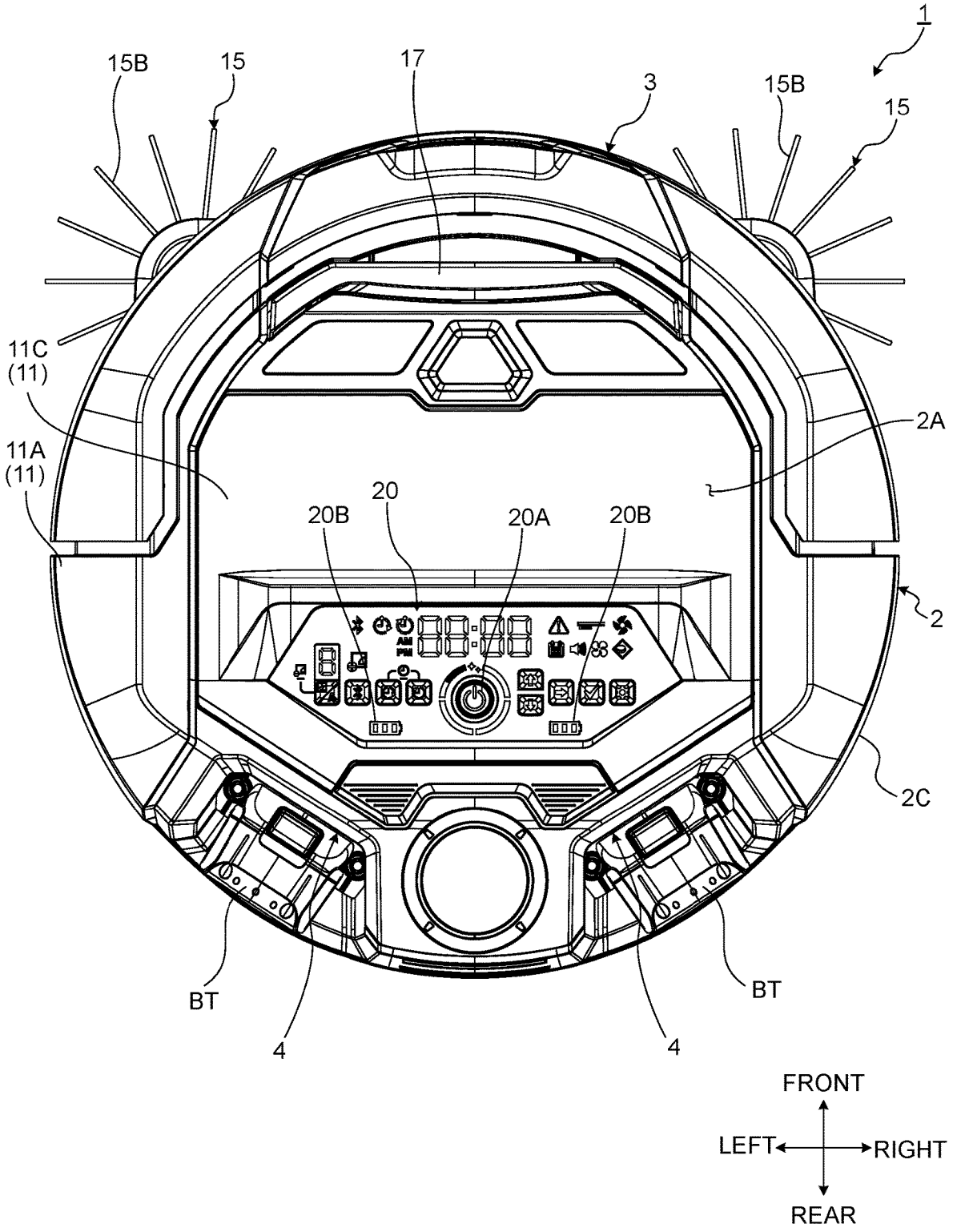
FIG. 2 is a top view of the robotic dust collector according to the embodiment.
Figure 3:
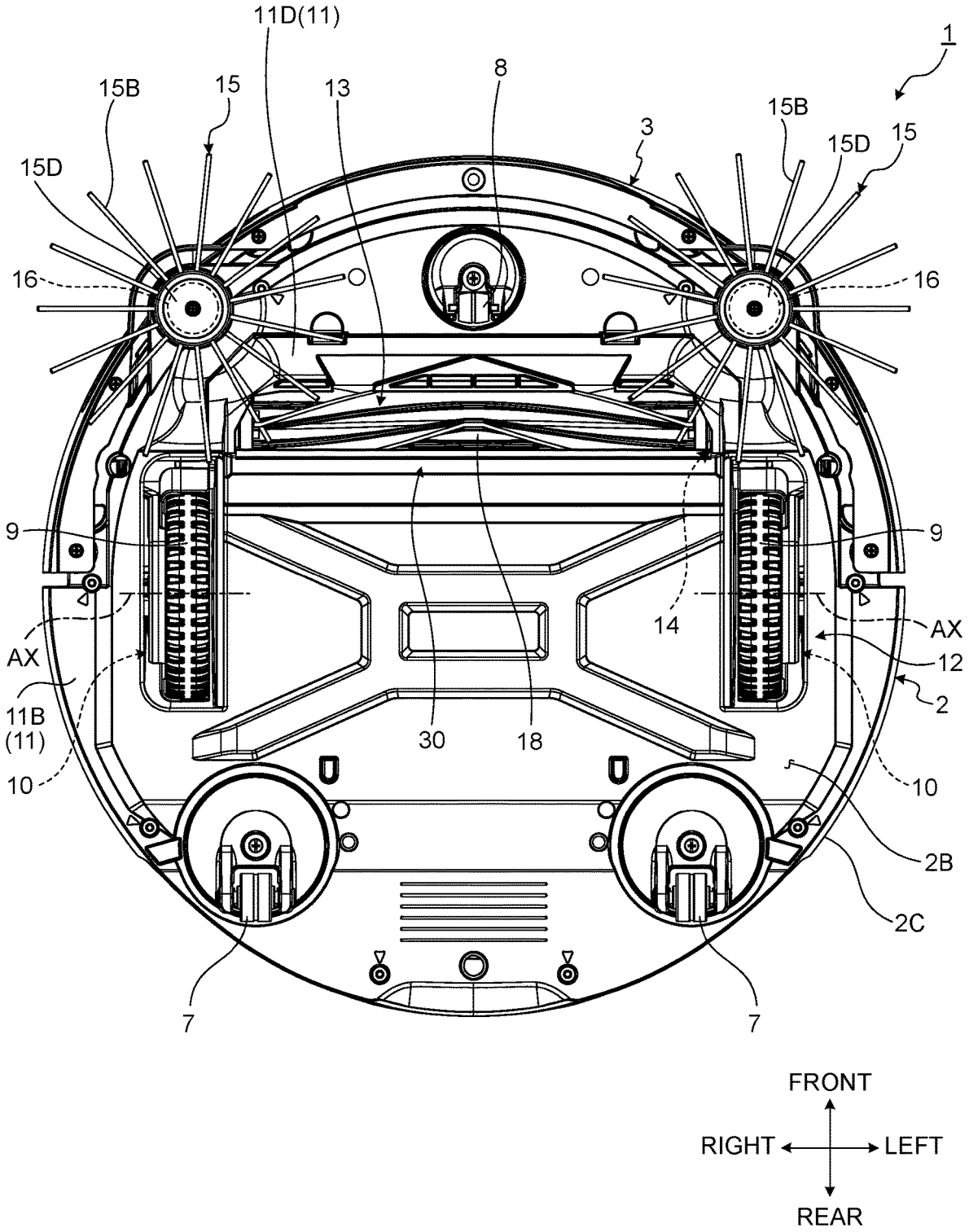
FIG. 3 is a bottom view of the robotic dust collector according to the embodiment.
Figure 4:
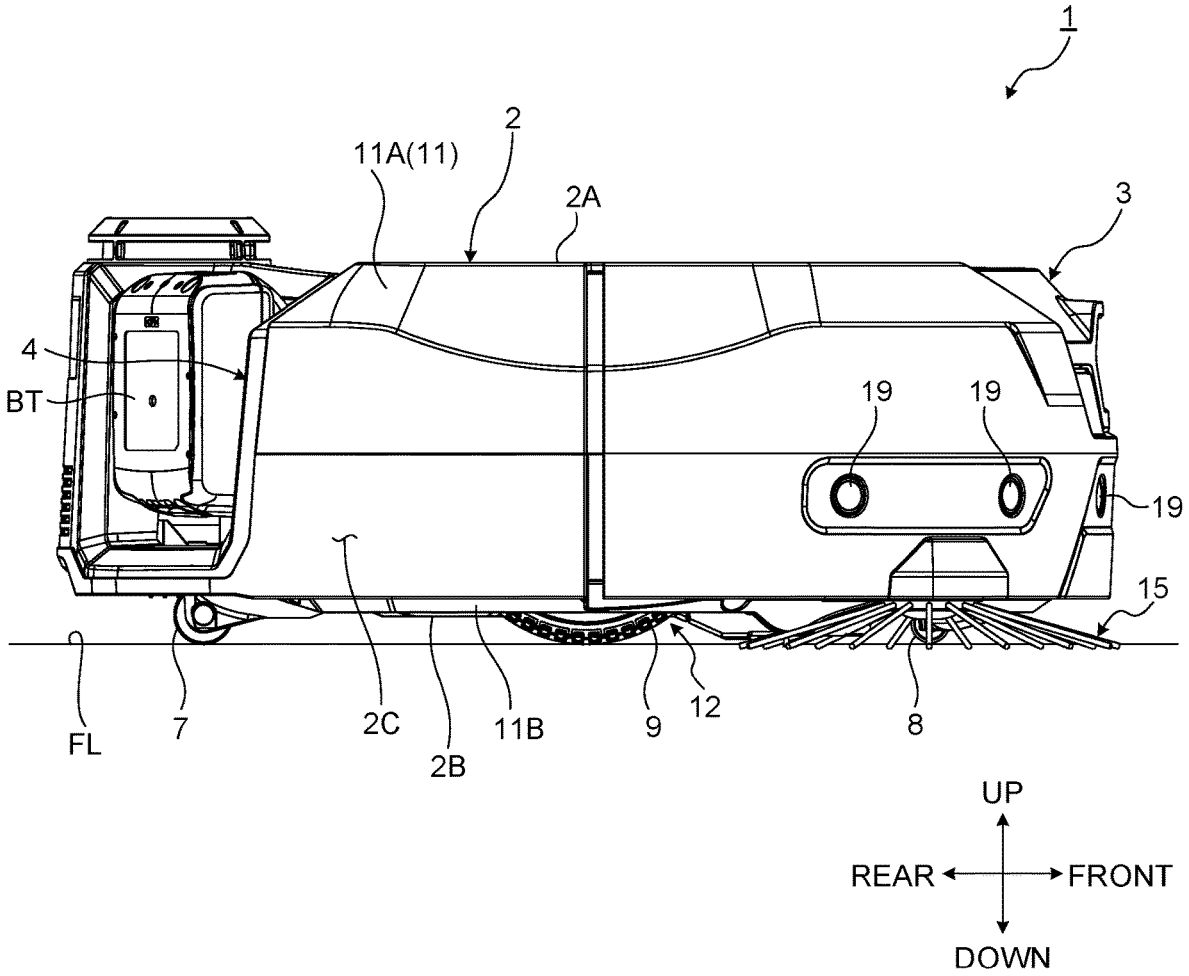
FIG. 4 is a side view of the robotic dust collector according to the embodiment.
Figure 5:
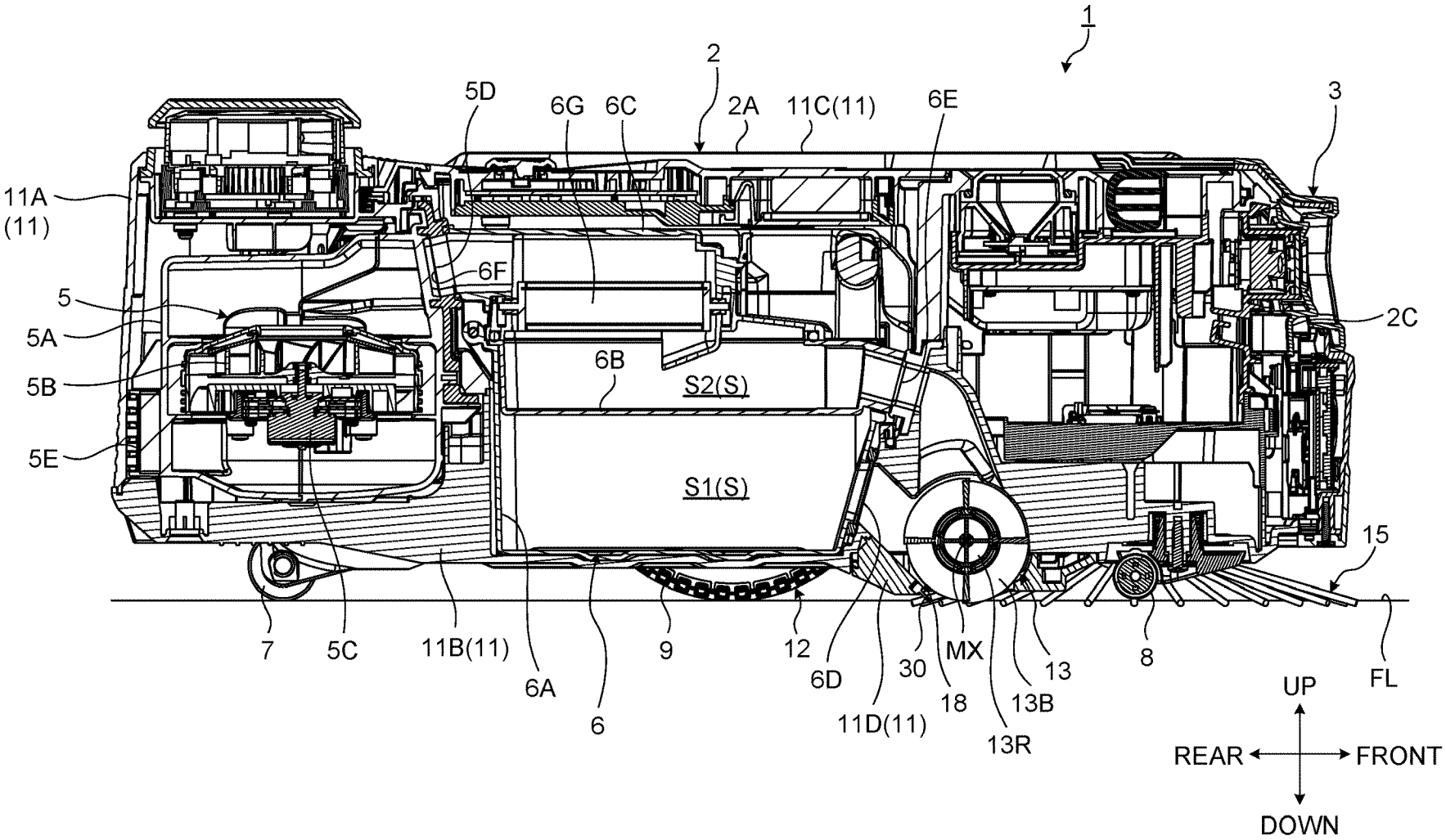
FIG. 5 is a sectional view of the robotic dust collector according to the embodiment.
Figure 6:
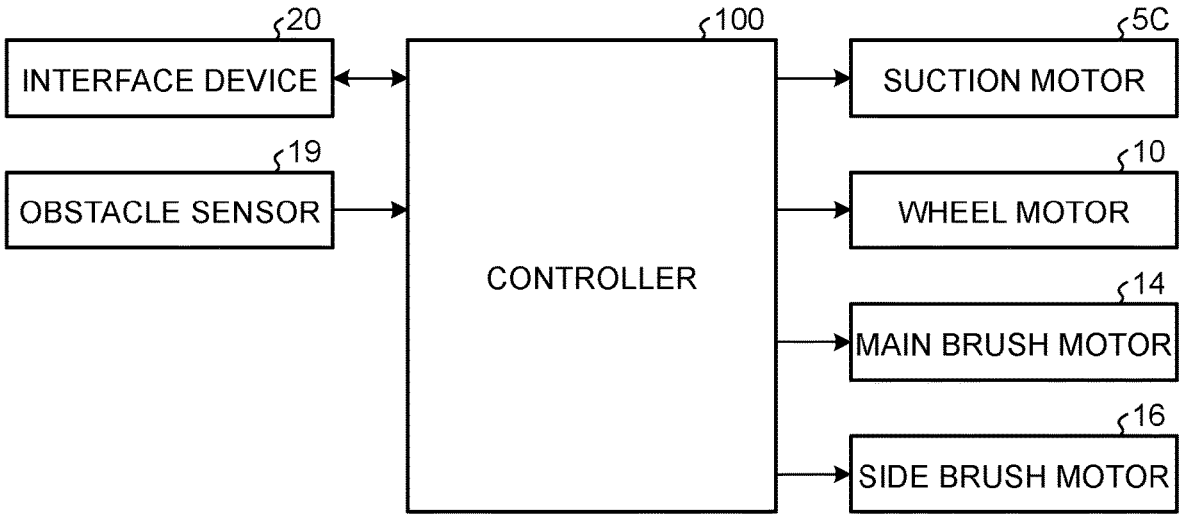
FIG. 6 is a block diagram of the robotic dust collector according to the embodiment.

FIG. 1 is a perspective view of the robotic dust collector 1 according to the embodiment. FIG. 2 is a top view of the robotic dust collector 1 according to the embodiment. FIG. 3 is a bottom view of the robotic dust collector 1 according to the embodiment. FIG. 4 is a side sectional view of the robotic dust collector 1 according to the present embodiment. FIG. 5 is a sectional view of the robotic dust collector 1 according to the present embodiment. FIG. 6 is a block diagram of the robotic dust collector 1 according to the embodiment.

The robotic dust collector 1 collects dirt and dust while autonomously traveling on a cleaning target surface FL. As illustrated in FIGS. 1 to 6, the robotic dust collector 1 includes a body 2, a bumper 3, battery mounting parts 4, a fan unit 5, a dust box 6, casters 7, a roller 8, a traveling device 12, a main brush 13, a main brush motor 14, a guide member 30, side brushes 15, side brush motors 16, a handle 17, obstacle sensors 19, an interface device 20, and a controller 100.

The body 2 has a top face 2A, a bottom face 2B facing the cleaning target surface FL, and a side face 2C that connects the edge of the top face 2A and the edge of the bottom face 2B. In a plane parallel to the top face 2A, the external shape of the body 2 is substantially circular.

The body 2 includes a housing 11 having an internal space. The housing 11 includes: an upper housing 11A; a lower housing 11B disposed below the upper housing 11A and connected to the upper housing 11A; a cover plate 11C detachably mounted on the upper housing 11A; and a bottom plate 11D attached to the lower housing 11B. The top face 2A is disposed on the upper housing 11A and the cover plate 11C. The bottom face 2B is disposed on the lower housing 11B and the bottom plate 11D.

The body 2 has a suction inlet 18 in the bottom face 2B. The suction inlet 18 is provided in the bottom plate 11D. The suction inlet 18 sucks dirt and dust on the cleaning target surface FL. The bottom plate 11D is a suction member having the suction inlet 18. The suction inlet 18 faces the cleaning target surface FL. The suction inlet 18 is provided in a front portion of the bottom face 2B. The suction inlet 18 has a rectangular shape elongated in a left-right direction. In the left-right direction, the center of the suction inlet 18 coincides with the center of the body 2. The center of the suction inlet 18 does not necessarily coincides with the center of the body 2.

The bumper 3 can move while facing at least a part of the side face 2C. The bumper 3 is movably supported by the body 2. The bumper 3 faces a front portion of the side face 2C. Upon colliding with an object present around the robotic dust collector 1, the bumper 3 moves relative to the body 2, thereby absorbing an impact that acts on the body 2.

The battery mounting parts 4 support batteries BT. The batteries BT are mounted on the battery mounting parts 4. The battery mounting parts 4 are provided on at least parts of the outer surface of the body 2. Recesses are provided in a rear portion of the upper housing 11A. The battery mounting parts 4 are provided inside the respective recesses in the upper housing 11A. Two such battery mounting parts 4 in total are provided.

The batteries BT mounted on the battery mounting parts 4 supply electric power to an electric or electronic device mounted on the robotic dust collector 1. The battery BT is a general-purpose battery that can be used as a power source for various electric devices. The battery BT can be used as a power source for power tools. The battery BT can be used as a power source for an electric device other than power tools. The battery BT can be used as a power source for a dust collector other than the robotic dust collector 1 according to the embodiment. Examples of the battery BT include a lithium-ion battery. The battery BT is a rechargeable battery that can be recharged. The battery mounting part 4 has a structure that is equivalent to the structure of a battery mounting part of a power tool.

A user of the robotic dust collector 1 can perform, in a space outside of the housing 11, work of mounting the batteries BT on the battery mounting parts 4 and removing the batteries BT from the battery mounting parts 4. The battery mounting part 4 includes a guide member that guides the battery BT to be mounted thereon, and body-side terminals that are connected to battery-side terminals provided to the battery BT. The user can mount the battery BT on the battery mounting part 4 by inserting the battery BT from above into the battery mounting part 4. The battery BT is inserted into the battery mounting part 4 by being guided by the guide member. With the battery BT mounted on the battery mounting part 4, the battery-side terminals of the battery BT are electrically connected to the respective body-side terminals of the battery mounting part 4. The user of the robotic dust collector 1 can remove the battery BT from the battery mounting part 4 by moving the battery BT upward.

The fan unit 5 is accommodated in the body 2. The fan unit 5 generates, at the suction inlet 18, suction power for sucking dirt and dust. The fan unit 5 is disposed in an internal space of the housing 11. The fan unit 5 is disposed between the two battery mounting parts 4 in a rear portion of the body 2. The fan unit 5 is connected to the suction inlet 18 via the dust box 6. The fan unit 5 generates, via the dust box 6, suction power for sucking dirt and dust at the suction inlet 18.

As illustrated in FIG. 5, the fan unit 5 includes: a casing 5A disposed in the internal space of the housing 11; a suction fan 5B provided inside the casing 5A; and a suction motor 5C that generates motive power to rotate the suction fan 5B. The casing 5A includes: an air inlet 5D connected to the dust box 6; and an air outlet 5E.

The suction motor 5C is driven by electric power supplied from the batteries BT. When the suction fan 5B rotates with the suction motor 5C driven, airflow is generated from the air inlet 5D toward the air outlet 5E. The air inlet 5D is connected to the suction inlet 18 via the dust box 6. When the suction fan 5B rotates, airflow is generated from the suction inlet 18 toward the air outlet 5E. As a result, the suction power is generated at the suction inlet 18.

The dust box 6 is accommodated in the body 2. The dust box 6 stores therein dirt and dust sucked through the suction inlet 18. The dust box 6 is disposed in the internal space of the housing 11. The dust box 6 is disposed between the suction inlet 18 and the fan unit 5. The dust box 6 collects and stores therein dirt and dust sucked through the suction inlet 18.

As illustrated in FIG. 5, the dust box 6 includes: a body member 6A; a tray member 6B disposed in an upper end of the body member 6A; and an upper plate member 6C disposed in an upper end of the tray member 6B. An opening is provided in the upper end of the body member 6A. The tray member 6B is disposed so as to close the opening in the upper end of the body member 6A. An opening is provided in the upper end of the tray member 6B. The upper plate member 6C is disposed so as to close the opening in the upper end of the tray member 6B.

The dust box 6 internally includes a storage space S. Dirt and dust from the suction inlet 18 are stored in the storage space S inside the dust box 6. The storage space S includes: a lower storage space S1 defined as a space between the body member 6A and the tray member 6B; and an upper storage space S2 defined as a space between the tray member 6B and the upper plate member 6C.

The dust box 6 includes: a lower collection port 6D connected to the lower storage space S1 and configured to collect dirt and dust from the suction inlet 18; an upper collection port 6E connected to the upper storage space S2 and configured to collect dirt and dust from the suction inlet 18; and an air outlet 6F connected to the upper storage space S2 and configured to discharge air from the upper storage space S2.

The lower collection port 6D is provided in a front portion of the body member 6A. The upper collection port 6E is provided above the lower collection port 6D. The upper collection port 6E is provided in a front portion of the tray member 6B. The air outlet 6F is disposed more rearward than the lower collection port 6D and the upper collection port 6E. The air outlet 6F is provided in a rear portion of the tray member 6B. The lower storage space S1 is connected to the suction inlet 18 via the lower collection port 6D. The upper storage space S2 is connected to the suction inlet 18 via the upper collection port 6E. The air outlet 6F is connected to the air inlet 5D of the fan unit 5. The fan unit 5 is connected to the suction inlet 18 via the air outlet 6F and the upper storage space S2. A filter 6G that traps dirt and dust is disposed between the air outlet 6F and the upper storage space S2.

The cover plate 11C is detachably mounted on the upper housing 11A. The cover plate 11C is disposed so as to close an opening provided in the upper housing 11A. The user of the robotic dust collector 1 can take out the dust box 6 from the internal space of the housing 11 via the opening in the upper housing 11A. The user of the robotic dust collector 1 can place the dust box 6 into the internal space of the housing 11 via the opening in the upper housing 11A.

The casters 7 and the roller 8 individually support the body 2 in such a manner that the body 2 can move. The casters 7 and the roller 8 are individually rotatably supported by the body 2. Two such casters 7 in total are provided in a rear portion of the bottom face 2B. One of the casters 7 is provided in a left portion of the body 2. The other caster 7 is provided in a right portion of the body 2. One such roller 8 in total is provided in the front portion of the bottom face 2B.

The traveling device 12 travels on the cleaning target surface FL in such a manner that the body 2, including the bottom plate 11D, moves in at least one of the frontward and rearward directions. The traveling of the traveling device 12 moves the body 2 in at least one of the frontward and rearward directions. The traveling device 12 includes wheels 9 and wheel motors 10.

The wheels 9 support the body 2 in such a manner that the body 2 can move. The wheels 9 rotate about a rotation axis AX. The rotation axis AX extends in the left-right direction. At least a part of each of the wheels 9 projects downward from the bottom face 2B. With the wheels 9 placed on the cleaning target surface FL, the bottom face 2B of the body 2 faces the cleaning target surface FL with a gap therebetween. Two such wheels 9 in total are provided. One of the wheels 9 is provided in the left portion of the body 2. The other wheel 9 is provided in the right portion of the body 2.

The wheel motors 10 generate motive power to rotate the wheels 9. The wheel motors 10 are driven by electric power supplied from the batteries BT. The wheel motors 10 are disposed in the internal space of the housing 11. Two such wheel motors 10 in total are provided. One of the wheel motors 10 generates motive power to rotate the wheel 9 provided in the left portion of the body 2. The other wheel motor 10 generates motive power to rotate the wheel 9 provided in the right portion of the body 2. When the wheels 9 rotate, the robotic dust collector 1 autonomously travels.

The wheel motors 10 are capable of changing the rotating direction of the wheels 9. When the wheels 9 rotate in a first direction, the robotic dust collector 1 moves frontward. When the wheels 9 rotate in a direction opposite to the first direction, the robotic dust collector 1 moves backward. The two wheel motors 10 are capable of being driven with different amounts of driving force. The robotic dust collector 1 turns when the two wheel motors 10 are driven by different amounts of driving force.

The main brush 13 is disposed in the suction inlet 18. The main brush 13 faces the cleaning target surface FL. The main brush 13 is elongated in the left-right direction. The main brush 13 rotates about a rotation axis MX. The rotation axis MX extends in the left-right direction. The main brush 13 includes: a rod member 13R extending in the left-right direction; and a plurality of brushes 13B connected to the outer surface of the rod member 13R. A left end and a right end of the rod member 13R are individually rotatably supported by the body 2. The rod member 13R is supported by the body 2 in such a manner that at least parts of the brushes 13B project below the bottom face 2B. With the wheels 9 placed on the cleaning target surface FL, at least a part of the main brush 13 makes contact with the cleaning target surface FL.

The main brush motor 14 generates motive power to rotate the main brush 13. The main brush motor 14 is driven by electric power supplied from the batteries BT. The main brush motor 14 is disposed in the internal space of the housing 11. When the main brush motor 14 is driven, the main brush 13 rotates. When the main brush 13 rotates, dirt and dust present on the cleaning target surface FL are gathered up and sucked in through the suction inlet 18.

The guide member 30 guides dirt and dust present on the cleaning target surface FL toward the suction inlet 18. At least a part of the guide member 30 is disposed in the suction inlet 18. At least a part of the guide member 30 is disposed more rearward than the rotation axis MX of the main brush 13. At least a part of the guide member 30 faces the cleaning target surface FL. The guide member 30 traps at least a part of dirt and dust gathered up by the main brush 13. The guide member 30 prevents dirt and dust gathered up by the main brush 13 from moving rearward from the suction inlet 18. At least a part of dirt and dust gathered up by the main brush 13 is trapped by the guide member 30 and sucked in through the suction inlet 18.

The side brushes 15 are disposed in the front portion of the bottom face 2B. The side brushes 15 face the cleaning target surface FL. At least a part of the side brush 15 is disposed more frontward than the body 2. Two such side brushes 15 in total are provided. One of the side brushes 15 is provided to the left of the suction inlet 18. The other side brush 15 is provided to the right of the suction inlet 18. The side brush 15 includes a disk member 15D and a plurality of brushes 15B radially connected to the disk member 15D. The disk member 15D is rotatably supported by the body 2. The disk member 15D is supported by the body 2 in such a manner that at least a part of the brushes 15B projects outside of the side face 2C. With the wheels 9 placed on the cleaning target surface FL, at least a part of the side brush 15 makes contact with the cleaning target surface FL.

The side brush motors 16 generate motive power to rotate the side brushes 15. The side brush motors 16 are driven by electric power supplied from the batteries BT. The side brush motors 16 are disposed in the internal space of the housing 11. When the side brush motors 16 are driven, the side brushes 15 rotate. When the side brushes 15 rotate, dirt and dust present on the cleaning target surface FL in an area surrounding the body 2 move to the suction inlet 18.

The handle 17 is provided in a front portion of the upper housing 11A. One end and the other end of the handle 17 are turnably coupled to the upper housing 11A. The user of the robotic dust collector 1 can lift the robotic dust collector 1 by gripping the handle 17. The user of the robotic dust collector 1 can carry the robotic dust collector 1.

The interface device 20 is disposed in a rear portion of the cover plate 11C. The interface device 20 includes a plurality of operation parts and a plurality of indicators that are to be operated by the user of the robotic dust collector 1. A power button 20A is exemplified as one of the operation parts of the interface device 20. Remaining power indicators 20B for the batteries BT are exemplified as the indicators of the interface device 20.

The obstacle sensor 19 detects, in a non-contact manner, an object present in at least a part of an area surrounding the robotic dust collector 1. The obstacle sensor 19 includes an ultrasonic sensor that detects objects by emitting ultrasonic waves. A plurality of such obstacle sensors 19 in total are provided at intervals on the side face 2C of the body 2. Based on detection data from the obstacle sensors 19, the controller 100 controls the wheel motors 10 to change the traveling direction of the traveling device 12 or stop traveling thereof so that the body 2 or the bumper 3 can avoid making contact with the object. The controller 100 may change the traveling direction of the traveling device 12 or stop traveling thereof after the body 2 or the bumper 3 makes contact with the object.

Bottom Plate and Guide Member

Figure 7:
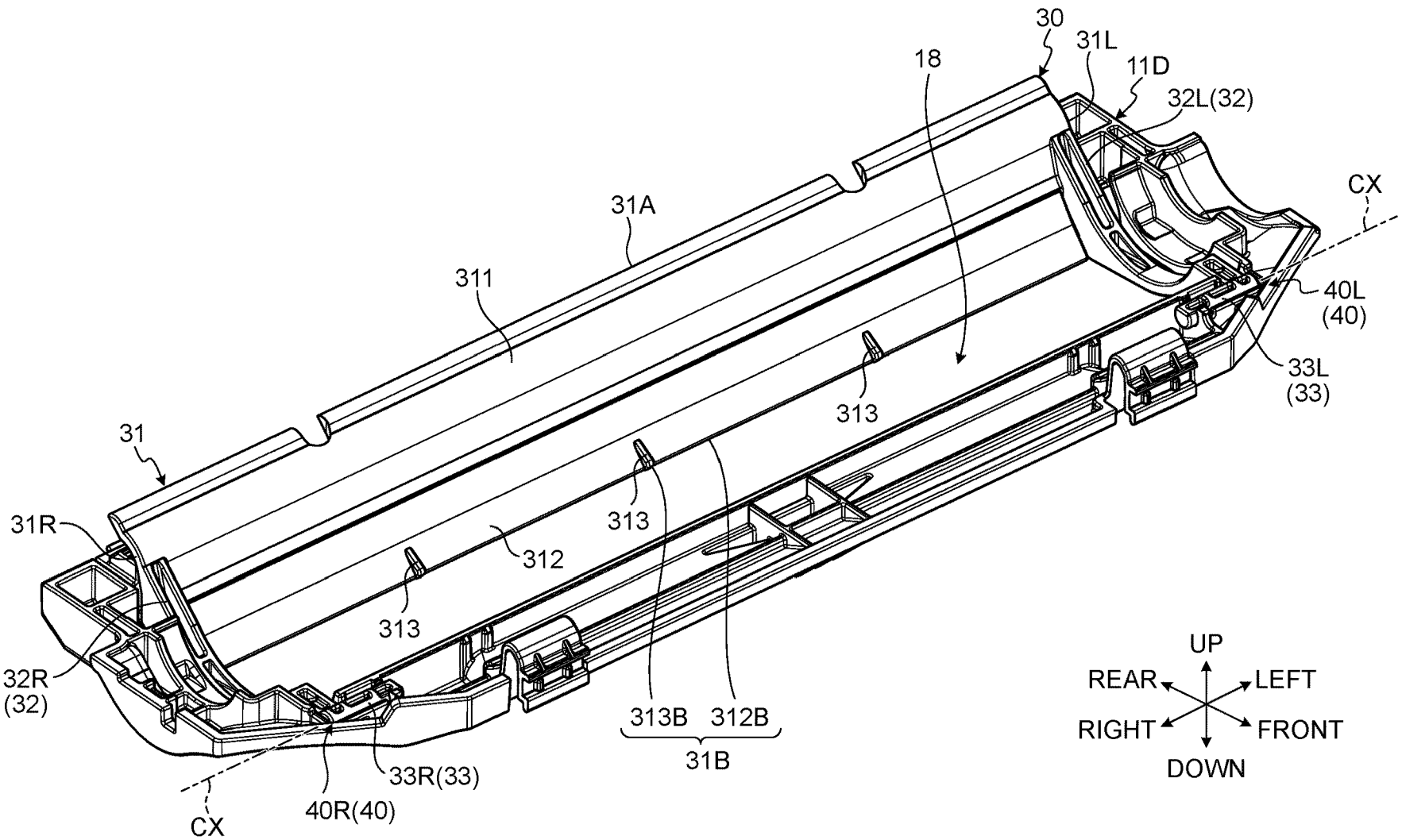
FIG. 7 is a perspective front view of a bottom plate and a guide member according to the embodiment.
Figure 8:
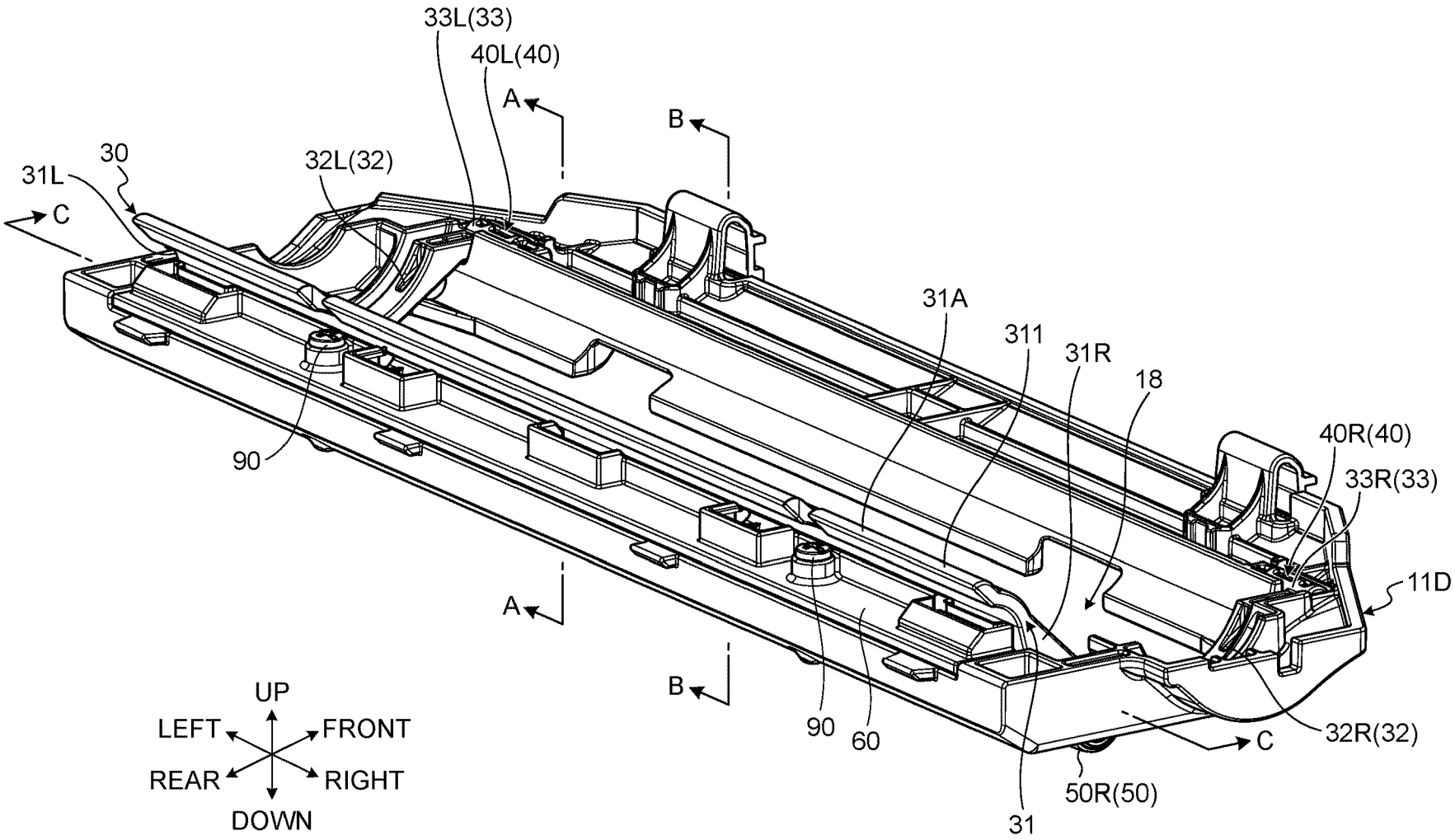
FIG. 8 is a perspective rear view of the bottom plate and the guide member according to the embodiment.
Figure 9:
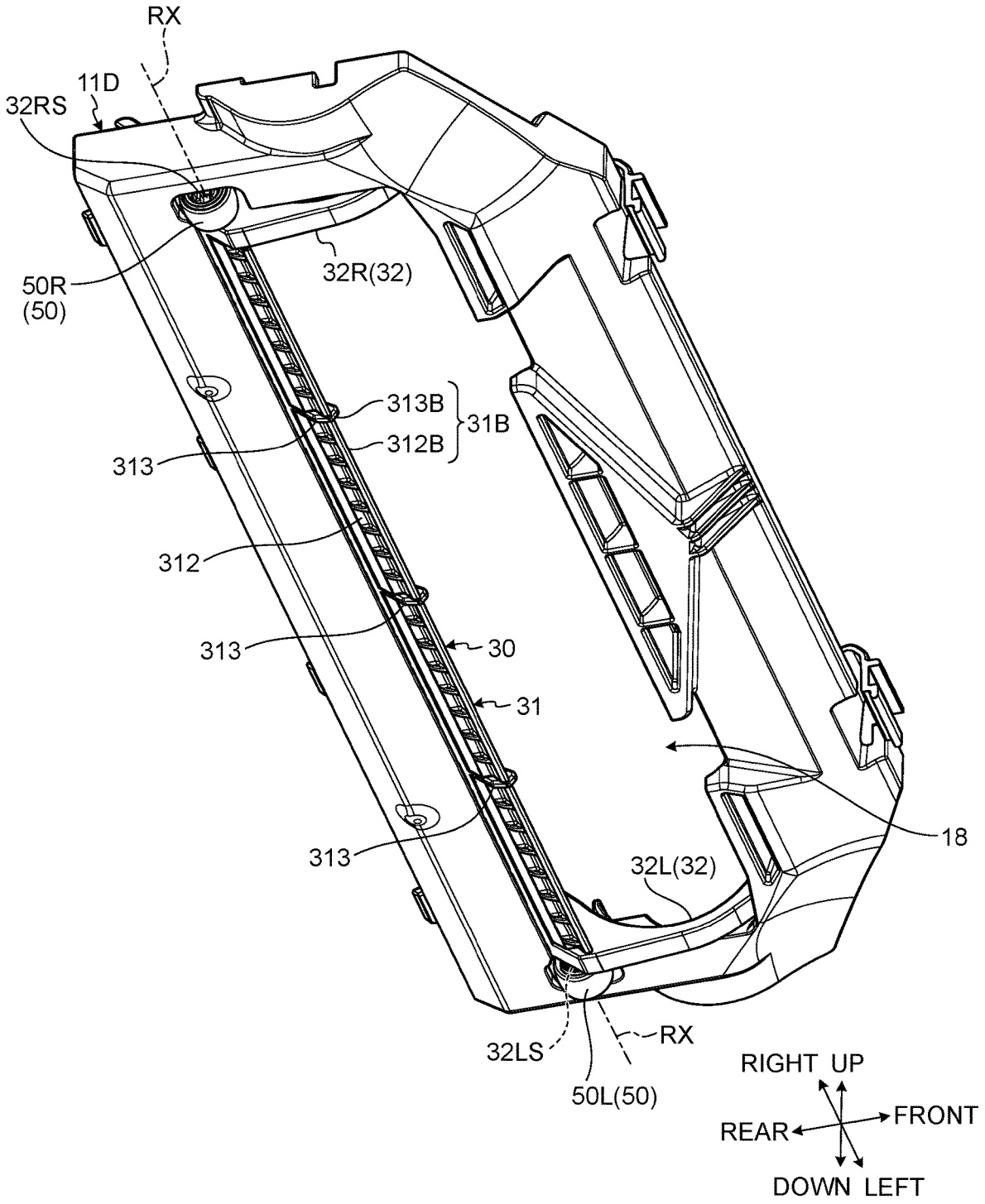
FIG. 9 is a perspective bottom view of the bottom plate and the guide member according to the embodiment.
Figure 10:
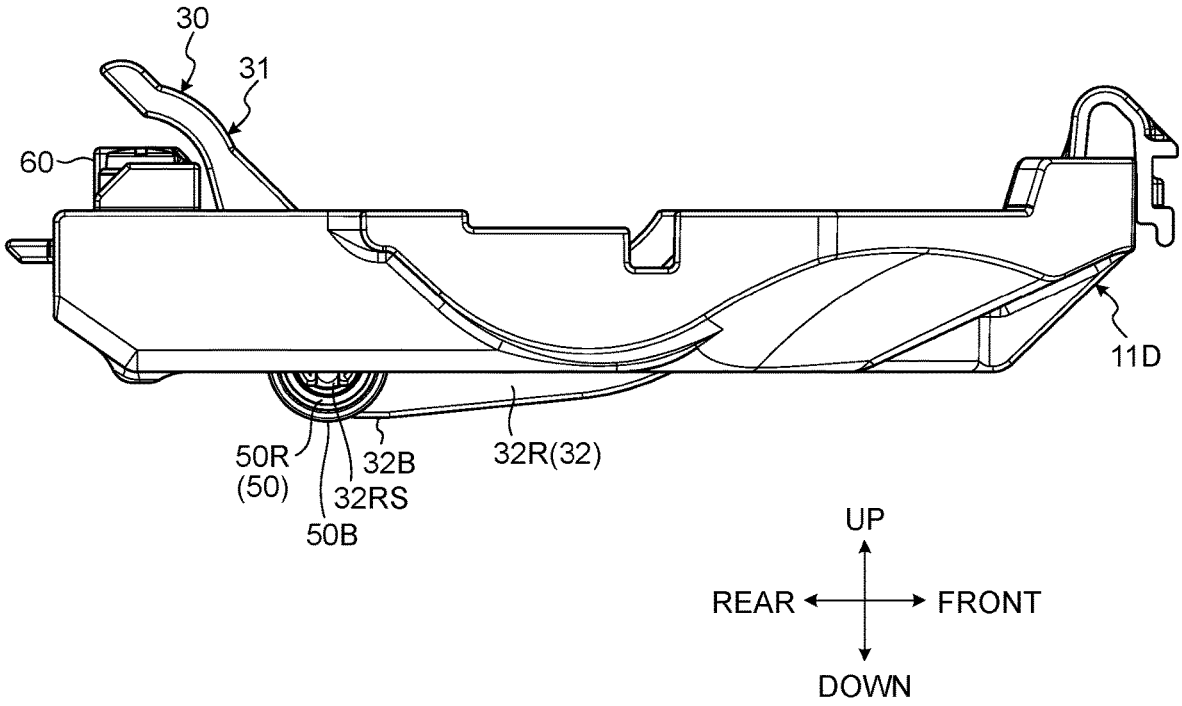
FIG. 10 is a side view of the bottom plate and the guide member according to the embodiment.

FIG. 7 is a perspective front view of the bottom plate 11D and the guide member 30 according to the embodiment. FIG. 8 is a perspective rear view of the bottom plate 11D and the guide member 30 according to the embodiment. FIG. 9 is a perspective bottom view of the bottom plate 11D and the guide member 30 according to the embodiment. FIG. 10 is a side view of the bottom plate 11D and the guide member 30 according to the embodiment.

The robotic dust collector 1 includes: the bottom plate 11D having the suction inlet 18; the guide member 30 that guides dirt and dust present on the cleaning target surface FL toward the suction inlet 18; support parts 40 that support the guide member 30 in such a manner that allows the guide member 30 to pivot about a pivot axis CX; and rollers 50 rotatably supported by the guide member 30 about a rotation axis RX.

The pivot axis CX of the guide member 30 extends in the left-right direction. In the embodiment, both ends of the guide member 30 in the left-right direction are supported by the support parts 40. The rotation axis RX of the rollers 50 extends in the left-right direction.

The bottom plate 11D is a suction member having the suction inlet 18. The suction inlet 18 includes an opening formed in a central portion of the bottom plate 11D.

At least a part of the guide member 30 is disposed in the suction inlet 18. The guide member 30 has: a blade part 31 disposed at the suction inlet 18 and facing the cleaning target surface FL; arm parts 32 extending frontward from the blade part 31; and joint parts 33 that are connected to respective front ends of the arm parts 32.

The blade part 31 has a plate-like shape elongated in the left-right direction. In a front-rear direction, the blade part 31 is disposed more rearward than the center of the suction inlet 18. In the embodiment, at least a part of the blade part 31 is disposed at a rear end of the suction inlet 18. The blade part 31 has a body part 311, a flexible part 312 supported by the body part 311, and rib parts 313 connected to at least parts of the flexible part 312.

The body part 311 is made of synthetic resin such as polycarbonate. The body part 311 is a plate-like member at an upper part of the blade part 31.

The flexible part 312 is flexible. The flexible part 312 is elastically deformable. The flexible part 312 is made of rubber. The flexible part 312 may be made of synthetic resin such as polyvinyl chloride (PVC). The flexible part 312 is a plate-like member at a lower part of the blade part 31.

The rib parts 313 are made of synthetic resin such as polycarbonate. A plurality of such rib parts 313 are disposed at intervals in the left-right direction. In the embodiment, gaps are formed in parts of the flexible part 312. A plurality of such gaps are formed side by side in the left-right direction. The rib parts 313 are disposed in the gaps in the flexible part 312. The rib parts 313 are connected to the flexible part 312.

The rib parts 313 are connected to a lower end of the body part 311. In the embodiment, the rib parts 313 are integral with the body part 311. The rib parts 313 project downward from the lower end of the body part 311. The rib parts 313 may be separate bodies from the body part 311.

The blade part 31 has an upper end 31A, a lower end 31B, a left end 31L, and a right end 31R. The upper end 31A includes an upper end of the body part 311. The lower end 31B includes a lower end 312B of the flexible part 312 and lower ends 313B of the rib parts 313. The left end 31L includes a left end of the body part 311 and a left end of the flexible part 312. The right end 31R includes a right end of the body part 311 and a right end of the flexible part 312.

The lower end 31B of the blade part 31 faces the cleaning target surface FL. The robotic dust collector 1 travels autonomously with the lower end 31B of the blade part 31 facing the cleaning target surface FL. The robotic dust collector 1 travels frontward with the lower end 31B of the blade part 31 facing the cleaning target surface FL. That is, the bottom plate 11D and the guide member 30 move frontward during cleaning operation on the cleaning target surface FL. A surface of the blade part 31 slopes downward toward the front. That is, the surface of the blade part 31 slopes downward toward the traveling direction of the robotic dust collector 1.

In the embodiment, the lower ends 313B of the rib parts 313 are disposed more downward than the lower end 312B of the flexible part 312. That is, the lower ends 313B of the rib parts 313 project more downward than the lower end 312B of the flexible part 312.

The arm parts 32 are made of synthetic resin such as polycarbonate. In the embodiment, the arm parts 32 are integral with the body part 311. The arm parts 32 may be separate bodies from the body part 311. The arm parts 32 include: a left arm part 32L extending frontward from the left end 31L of the blade part 31; and a right arm part 32R extending frontward from the right end 31R of the blade part 31. The left arm part 32L is disposed at a left end of the suction inlet 18. The right arm part 32R is disposed at a right end of the suction inlet 18.

The joint parts 33 are disposed more frontward than the blade part 31. In the embodiment, the joint parts 33 are disposed more frontward than the suction inlet 18. The joint parts 33 are each substantially cylindrical. The joint part 33 is elongated in left-right direction. The joint part 33 is made of synthetic resin such as polycarbonate. In the embodiment, the joint parts 33 are integral with the respective arm parts 32. The joint parts 33 may be separate bodies from the arm parts 32. The joint parts 33 include: a left joint part 33L connected to a front end of the left arm part 32L; and a right joint part 33R connected to a front end of the right arm part 32R. The left joint part 33L extends rightward from the front end of the left arm part 32L. The right joint part 33R extends leftward from the front end of the right arm part 32R.

The support parts 40 support the guide member 30 in such a manner that allows the guide member 30 to pivot about the pivot axis CX so as to allow the blade part 31 to move in an up-down direction. In the embodiment, the support parts 40 are provided to the bottom plate 11D. The support parts 40 are disposed more frontward than the rear end of the suction inlet 18. In the embodiment, the support parts 40 are disposed more frontward than the suction inlet 18.

In the embodiment, the support parts 40 support the joint parts 33 in such a manner that allows the joint parts 33 to pivot. The joint parts 33 include the pivot axis CX of the guide member 30. The joint parts 33 are supported by the support parts 40 in such a manner as to be pivotable about the pivot axis CX. The pivot axis CX of the guide member 30 is disposed more frontward than the blade part 31. In the embodiment, the pivot axis CX of the guide member 30 is disposed more frontward than the suction inlet 18.

The support parts 40 include recesses configured to accommodate at least parts of the respective joint parts 33. The support parts 40 include: a left support part 40L that supports the left joint part 33L; and a right support part 40R that supports the right joint part 33R. The left support part 40L is disposed frontward of a left portion of a front end of the suction inlet 18. The right support part 40R is disposed frontward of a right portion of the front end of the suction inlet 18.

The rollers 50 are rotatably supported by the respective arm parts 32. The rollers 50 include: a left roller 50L rotatably supported by the left arm part 32L; and a right roller 50R rotatably supported by the right arm part 32R. The left roller 50L is disposed more leftward than the left arm part 32L. The right roller 50R is disposed more rightward of the right arm part 32R. The left arm part 32L has a shaft part 32LS supporting the left roller 50L in such a manner that allows the left roller 50L to rotate. The shaft part 32LS projects leftward from a left face of the left arm part 32L. The right arm part 32R has a shaft part 32RS supporting the right roller 50R in such a manner that allows the right roller 50R to rotate. The shaft part 32RS projects rightward from a right face of the right arm part 32R.

As illustrated in FIG. 10, the lower ends 50B of the rollers 50 are disposed more downward than the lower ends 32B of the arm parts 32. That is, with the bottom face 2B placed parallel to a horizontal plane, the lower ends 50B of the rollers 50 project more downward than the lower ends 32B of the arm parts 32. For example, when the casters 7, the roller 8, and the wheels 9 are all in contact with the cleaning target surface FL that is horizontal and flat, the distance between the lower end 50B of each of the rollers 50 and the cleaning target surface FL is shorter than the distance between the lower end 32B of each of the arm parts 32 and the cleaning target surface FL.

In the up-down direction, the positions of the lower ends 313B of the rib parts 313 are substantially the same as the position of the lower end 32B of the arm part 32. That is, with the bottom face 2B placed parallel to a horizontal plane, the lower ends 313B of the rib parts 313 are substantially as high as the lower end 32B of the arm part 32. For example, when the casters 7, the roller 8, and the wheels 9 are all in contact with the cleaning target surface FL that is horizontal and flat, the distance between the lower end 313B of each of the rib parts 313 and the cleaning target surface FL is equal to the distance between the lower end 32B of the arm part 32 and the cleaning target surface FL.

The lower ends 50B of the rollers 50 are disposed more downward than the lower ends 313B of the rib parts 313 and the lower ends 32B of the arm parts 32. That is, with the bottom face 2B placed parallel to a horizontal plane, the lower ends 50B of the rollers 50 project more downward than the lower ends 313B of the rib parts 313 and the lower ends 32B of the arm parts 32.

The lower ends 313B of the rib parts 313 and the lower ends 32B of the arm parts 32 are disposed more downward than the lower end 312B of the flexible part 312. That is, with the bottom face 2B placed parallel to a horizontal plane, the lower ends 313B of the rib parts 313 and the lower ends 32B of the arm parts 32 project more downward than the lower end 312B of the flexible part 312.

That is, with the bottom face 2B placed parallel to a horizontal plane, the lower end 31B of the blade part 31 is disposed more upward than the lower ends 50B of the rollers 50. For example, when the casters 7, the roller 8, and the wheels 9 are all in contact with the cleaning target surface FL that is horizontal and flat, the lower ends 50B of the rollers 50 make contact with the cleaning target surface FL while the lower end 31B of the blade part 31 does not make contact with the cleaning target surface FL. When the blade part 31 moves in contact with the cleaning target surface FL while the robotic dust collector 1 autonomously travels, the blade part 31 may vibrate. When the blade part 31 vibrates, noise may occur from the robotic dust collector 1. In the embodiment, the blade part 31 does not make contact with the cleaning target surface FL, whereby noise is prevented from occurring from the robotic dust collector 1.

Figure 11:
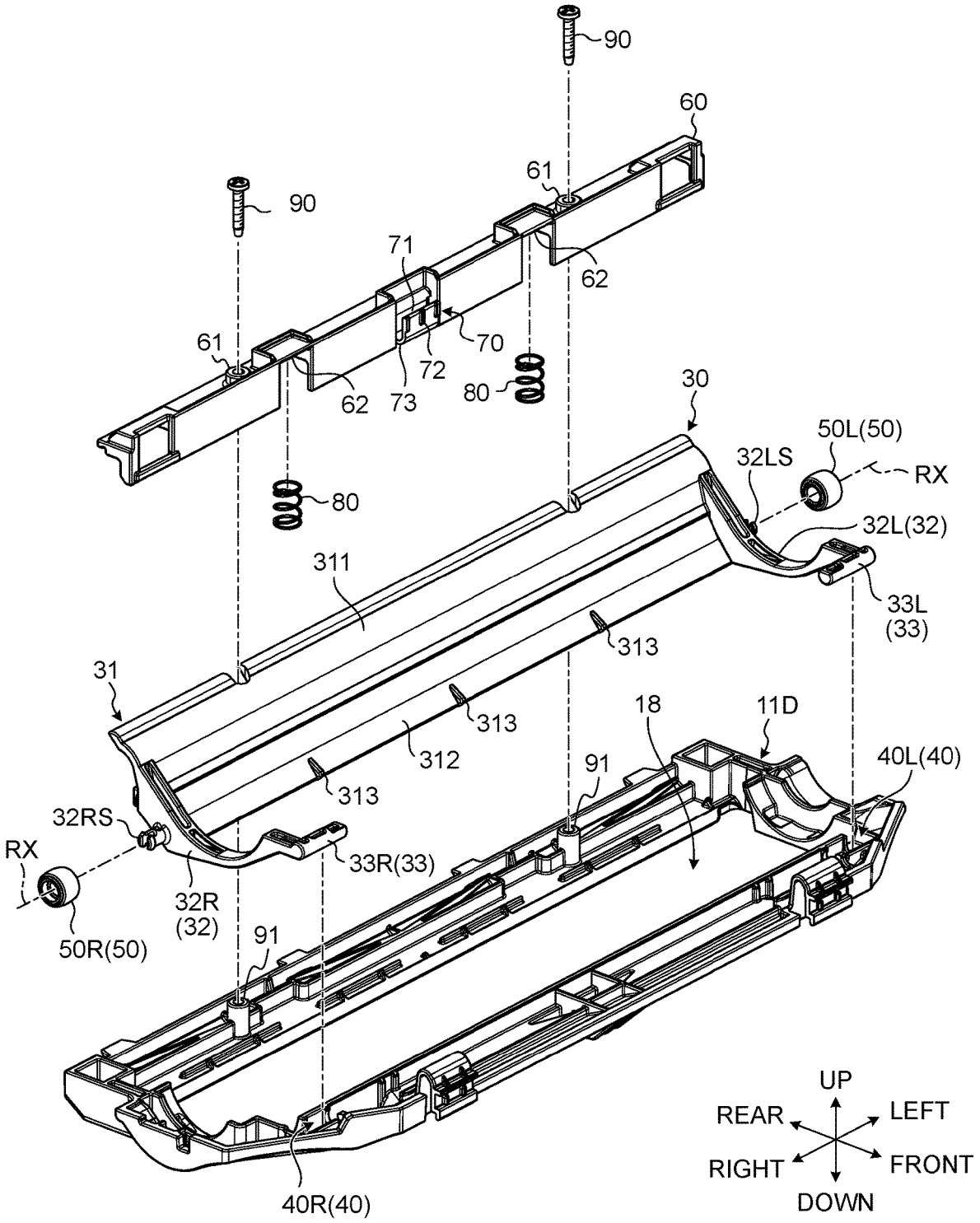
FIG. 11 is an exploded perspective front view of the bottom plate and the guide member according to the embodiment.
Figure 12:
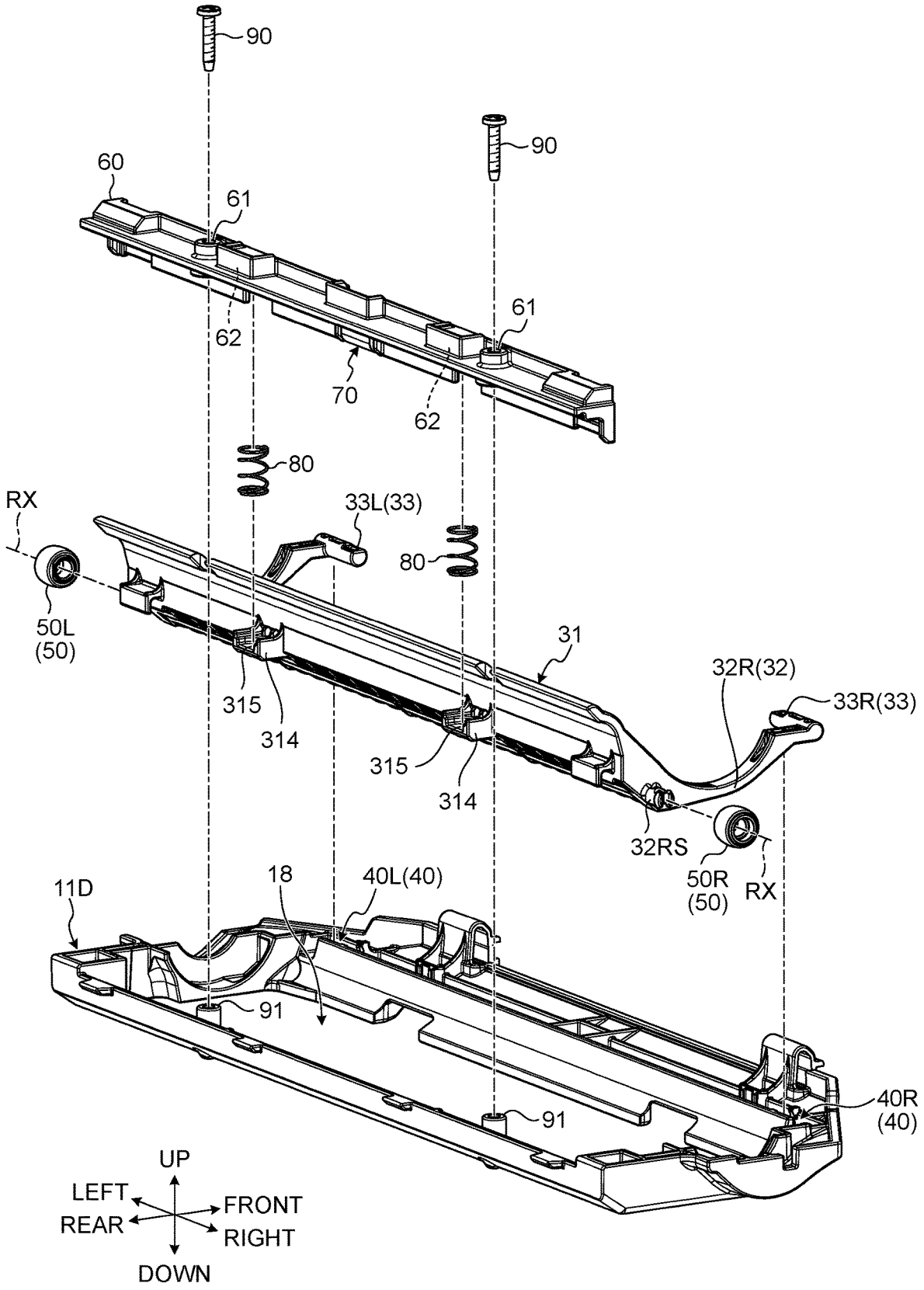
FIG. 12 is an exploded perspective rear view of the bottom plate and the guide member according to the embodiment.
Figure 13:
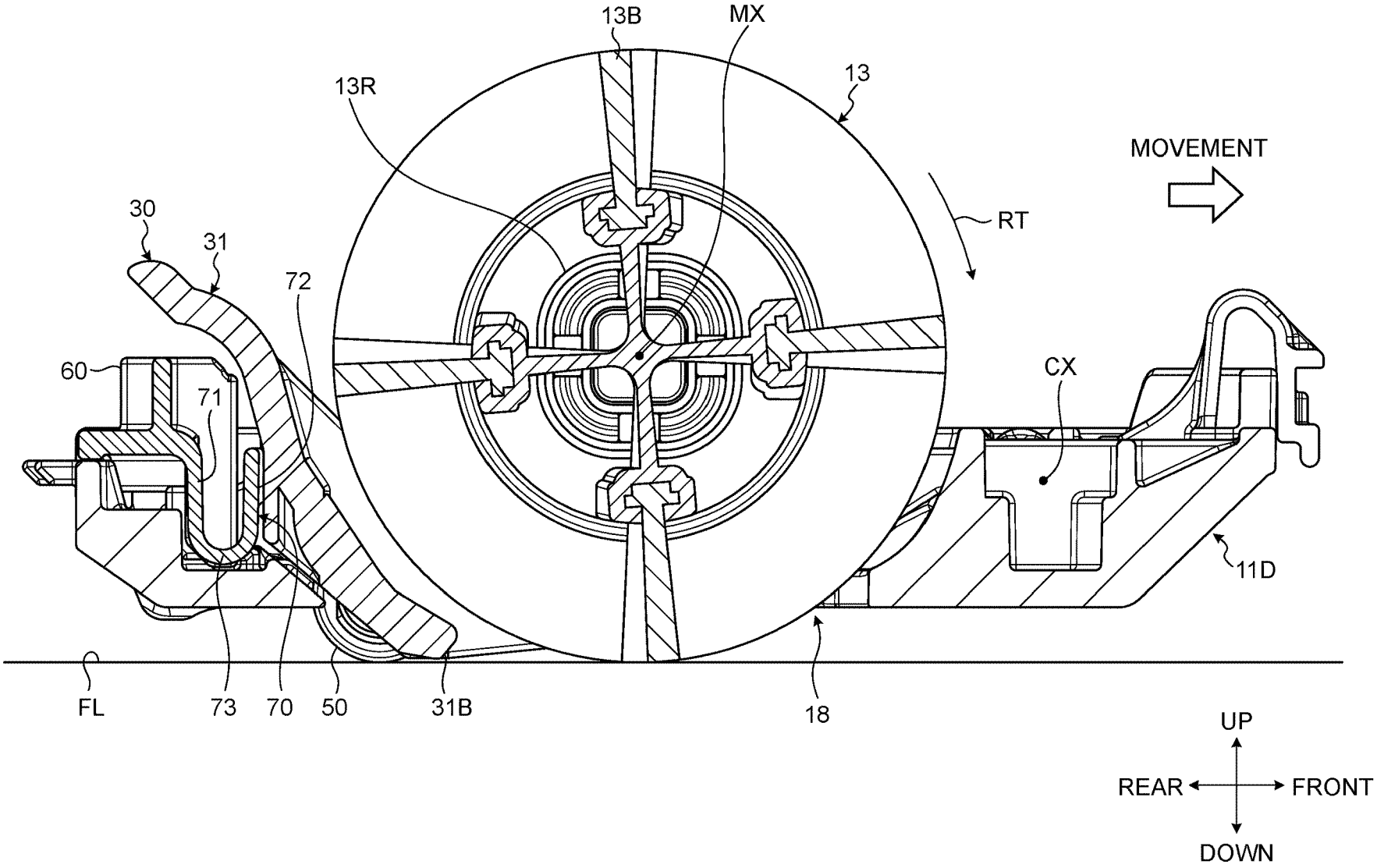
FIG. 13 is a sectional view of the bottom plate and the guide member according to the embodiment.
Figure 14:
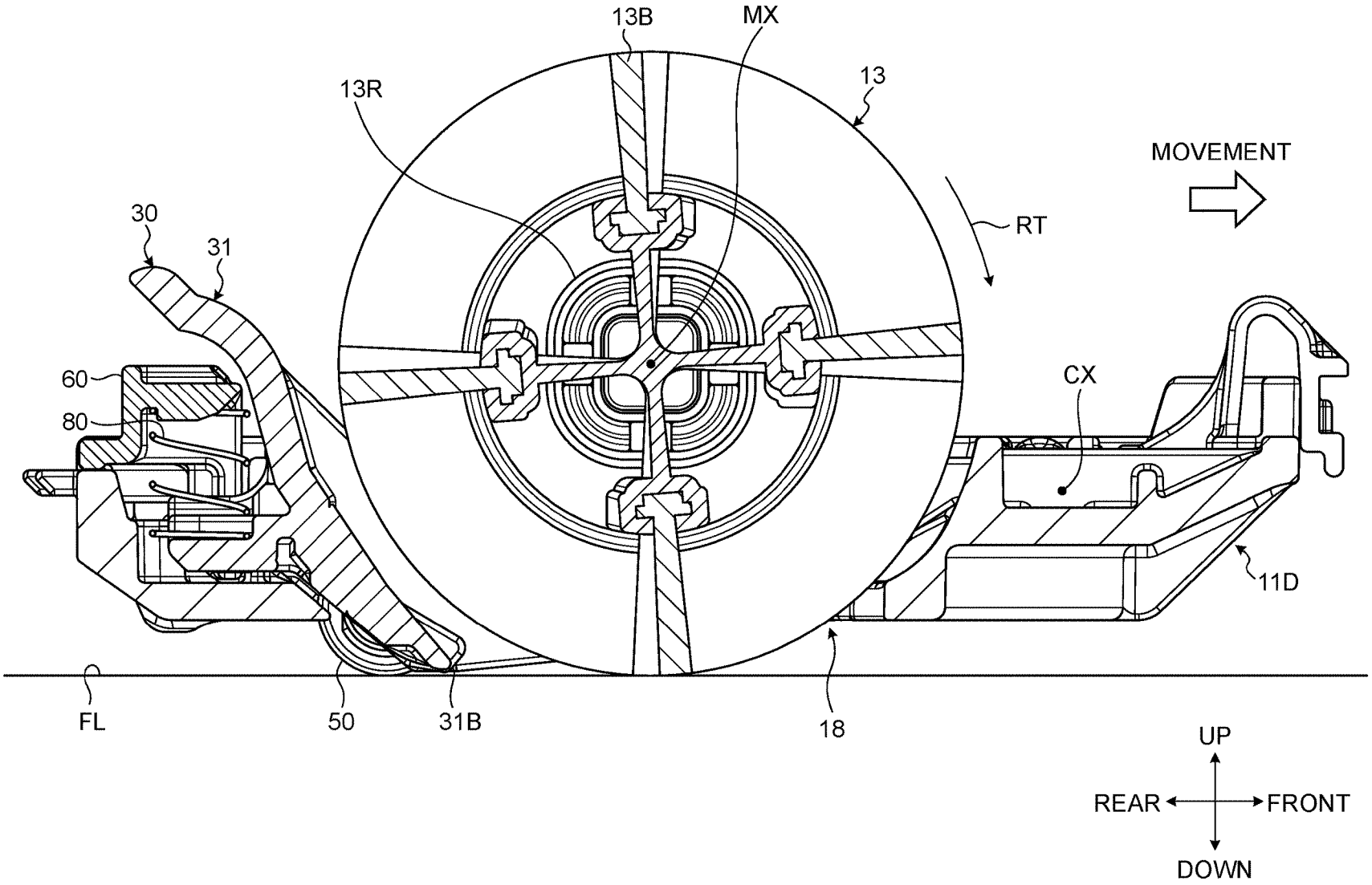
FIG. 14 is a sectional view of the bottom plate and the guide member according to the embodiment.
Figure 15:
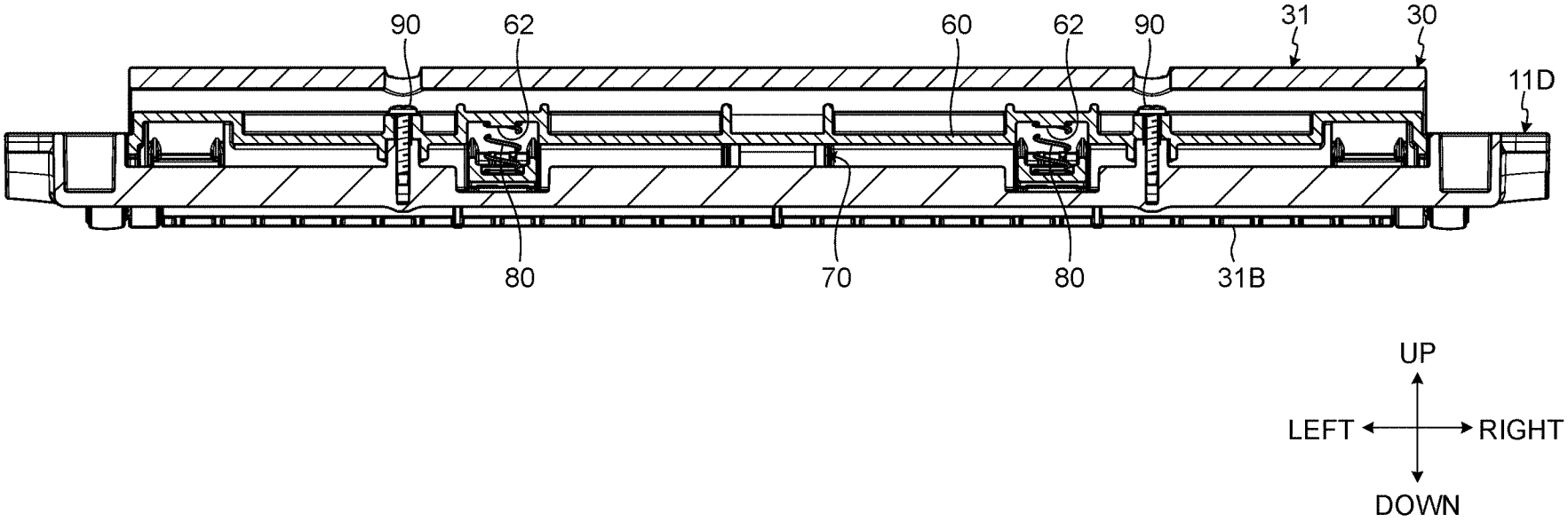
FIG. 15 is a sectional view of the bottom plate and the guide member according to the embodiment.

FIG. 11 is an exploded perspective front view of the bottom plate 11D and the guide member 30 according to the embodiment. FIG. 12 is an exploded perspective rear view of the bottom plate 11D and the guide member 30 according to the embodiment. FIGS. 13 to 15 are sectional views of the bottom plate and the guide member according to the embodiment. FIG. 13 corresponds to a section taken along the A-A line of FIG. 8. FIG. 14 corresponds to a section taken along the B-B line of FIG. 8. FIG. 15 corresponds to a section taken along the C-C line of FIG. 8.

The robotic dust collector 1 includes: a fixing member 60 disposed rearward of the blade part 31 and fixed to the bottom plate 11D; a biasing member 70 configured to exert biasing force on at least a part of the blade part 31; and elastic members 80 configured to bias the blade part 31 downward.

The fixing member 60 has a plate-like shape elongated in the left-right direction. The fixing member 60 is made of synthetic resin such as polycarbonate. The fixing member 60 is detachable from the bottom plate 11D. The fixing member 60 is disposed upward of a rear portion of the bottom plate 11D.

The fixing member 60 is fixed to the rear portion of the bottom plate 11D with two screws 90. The fixing member 60 has openings 61 in which respective shaft parts of the screws 90 are disposed. The bottom plate 11D has screw holes 91 that are coupled to the screws 90. A threaded groove that engages with the thread of the screw 90 is formed on the inner surface of each of the screw holes 91.

The biasing member 70 exerts biasing force on the surface of the blade part 31 so as to prevent deformation of the blade part 31 caused by making contact with the cleaning target surface FL. As described above, the lower end 31B of the blade part 31 is disposed more upward than the lower ends 50B of the rollers 50. When the cleaning target surface FL is a flat surface (even surface) such as a floor, the blade part 31 does not make contact with the cleaning target surface FL. In contrast, depending on the surface condition of the cleaning target surface FL, the blade part 31 may make contact with the cleaning target surface FL while the robotic dust collector 1 autonomously travels. For example, when the cleaning target surface FL is an irregular surface (uneven surface) such as a carpet surface, the blade part 31 may make contact with the cleaning target surface FL. When the blade part 31 moves in contact with the cleaning target surface FL while the robotic dust collector 1 autonomously travels, the blade part 31 may be deformed. When the blade part 31 is deformed, abnormal noise may occur from the robotic dust collector 1. In the embodiment, the biasing member 70 exerts biasing force on the surface of the blade part 31 so as to prevent the blade part 31 from being deformed while the robotic dust collector 1 travels with the lower end 31B of the blade part 31 and the cleaning target surface FL in contact with each other.

The biasing member 70 is disposed rearward of the blade part 31. The biasing member 70 exerts biasing force on the rear surface of the blade part 31. The biasing member 70 exerts biasing force on the blade part 31 toward the front.

The biasing member 70 is provided on the fixing member 60. In the embodiment, the biasing member 70 is integral with the fixing member 60. The biasing member 70 is made of synthetic resin such as polycarbonate.

In the left-right direction, the biasing member 70 is disposed at a central portion of the fixing member 60. The biasing member 70 includes: a first extending part 71 extending in the up-down direction; a second extending part 72 disposed more frontward than the first extending part 71 and configured to make contact with the rear surface of the blade part 31; and a bent part 73 connecting the lower end of the first extending part 71 and the lower end of the second extending part 72. An upper end of the first extending part 71 is connected to the fixing member 60. The upper end of the first extending part 71 is apart from an upper end of the second extending part 72. The biasing member 70 can be elastically deformed in such a manner as to bring the upper end of the first extending part 71 and the upper end of the second extending part 72 close to and apart from each other.

The both ends of the blade part 31 in the left-right direction are supported by the support parts 40 via the arm parts 32 and the joint parts 33. The biasing member 70 exerts biasing force on the central portion of the blade part 31 in the left-right direction.

The elastic members 80 generate elastic force that biases the lower end 31B of the blade part 31 downward. The lower end 31B of the blade part 31 is biased toward the cleaning target surface FL by the elastic force of the elastic members 80.

The elastic members 80 are coil springs. In the embodiment, two such elastic members 80 are disposed side by side in the left-right direction.

The elastic members 80 are disposed between the fixing member 60 and the blade part 31. In the embodiment, the blade part 31 has projections 314 projecting rearward from the rear surface of the blade part 31. Recesses 315 are formed on respective top faces of the projections 314. Lower ends of the elastic members 80 are supported by the respective recesses 315. The projections 314 of the blade part 31 support the lower ends of the elastic members 80. The fixing member 60 has recesses 62 in which respective upper ends of the elastic members 80 are disposed. The fixing member 60 supports the upper ends of the elastic members 80.

The elastic members 80, in a compressed state, are positioned between the fixing member 60 and the projections 314 of the blade part 31. The elastic members 80 exert downward elastic force on the projections 314. With the downward elastic force exerted on the projections 314, the lower end 31B of the blade part 31 is biased toward the cleaning target surface FL.

Figure 16:
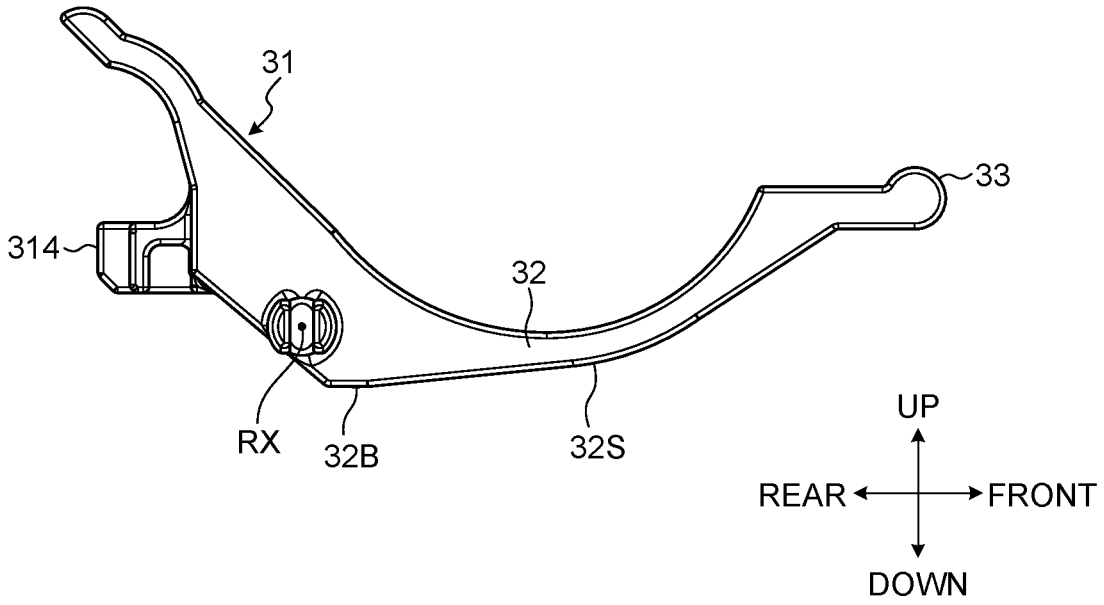
FIG. 16 is a side view of a blade part according to the embodiment.

FIG. 16 is a side view of the blade part 31 according to the embodiment. As illustrated in FIG. 16, a lower face 32S of each of the arm parts 32 between the lower end 32B of the corresponding arm part 32 and the corresponding joint part 33 is curved downward. In a plane orthogonal to the rotation axis RX, the lower face 32S is arc-like.

Operation

Next, operation of the robotic dust collector 1 are described. With the wheels 9 making contact with the cleaning target surface FL, the main brush 13 and the side brushes 15 make contact with the cleaning target surface FL. Electric power output from the batteries BT is supplied to the wheel motors 10, the suction motor 5C, the main brush motor 14, and the side brush motors 16.

When the wheels 9 rotate by having electric power supplied to the wheel motors 10 from the batteries BT with the wheels 9 making contact with the cleaning target surface FL, the robotic dust collector 1 autonomously travels on the cleaning target surface FL.

When the suction fan 5B rotates with electric power supplied to the suction motor 5C from the batteries BT, airflow from the air inlet 5D toward the air outlet 5E is generated. The air inlet 5D is connected to the suction inlet 18 via the upper storage space S2 of the dust box 6. Thus, when the suction fan 5B rotates, airflow from the suction inlet 18 toward the air outlet 5E via the upper storage space S2 is generated. As a result, suction power for sucking dirt and dust is generated at the suction inlet 18.

When the main brush 13 rotates with electric power supplied to the main brush motor 14 from the batteries BT, dirt and dust on the cleaning target surface FL is gathered up by the main brush 13. The suction inlet 18 sucks up at least a part of dirt and dust gathered up by the main brush 13.

When the side brushes 15 rotate with electric power supplied to the side brush motors 16 from the batteries BT, the side brushes 15 cause dirt and dust present on the cleaning target surface FL in an area surrounding the body 2 to move to the suction inlet 18. The suction inlet 18 sucks at least a part of dirt and dust caused by the side brushes 15 to move to the suction inlet 18 and gathered up by the main brush 13.

Relatively small or relatively light particles of dirt and dust present on the cleaning target surface FL are sent into the upper storage space S2 via the upper collection port 6E after being sucked through the suction inlet 18. The dirt and dust are stored in the upper storage space S2. The filter 6G is provided between the upper storage space S2 and the air outlet 6F. Thus, dirt and dust sent into the upper storage space S2 via the upper collection port 6E are trapped by the filter 6G and stay in the upper storage space S2. Air sucked through the suction inlet 18 is sent to the fan unit 5 via the air outlet 6F after passing the filter 6G. Air sent to the fan unit 5 is discharged from the air outlet 5E.

Relatively large or relatively heavy particles of dirt and dust present on the cleaning target surface FL are gathered up by the main brush 13 and then sent into the lower storage space S1 via the lower collection port 6D. The dirt and dust are stored in the lower storage space S1.

As illustrated in FIGS. 13 and 14, in cleaning operation on the cleaning target surface FL, the traveling device 12 moves the body 2, including the bottom plate 11D, frontward. In cleaning operation on the cleaning target surface FL, the bottom plate 11D and the guide member 30 are moved frontward by the traveling device 12. The body 2 moves frontward with the lower end 31B of the guide member 30 facing the cleaning target surface FL. The main brush 13 rotates frontward about the rotation axis MX as indicated by the arrow RT.

The guide member 30 is supported by the support parts 40 in such a manner that the surface of the blade part 31 slopes downward toward the front. That is, the guide member 30 is supported by the support parts 40 in such a manner that the surface of the blade part 31 slopes downward toward the traveling direction of the robotic dust collector 1.

The guide member 30 pivots about the pivot axis CX in such a manner that allows the blade part 31 to move in the up-down direction. The blade part 31 moves in the up-down direction by pivoting partially around the pivot axis CX. The blade part 31 is movable in the up-down direction. Therefore, the blade part 31 can move in the up-down direction in accordance with the shape of the cleaning target surface FL, for example, even when the cleaning target surface FL is an irregular surface (uneven surface). The blade part 31 is biased toward the cleaning target surface FL by the elastic force generated by the elastic members 80. Therefore, in the cleaning operation, the lower end 31B of the blade part 31 can continue to face the cleaning target surface FL.

The rollers 50 are rotatably supported by the arm parts 32 of the guide member 30. When the guide member 30 pivots about the pivot axis CX, the rollers 50 pivots partially around the pivot axis CX. The rollers 50 can move in the up-down direction together with the blade part 31 by pivoting partially around the pivot axis CX.

Operation of Biasing Member

Figure 17:
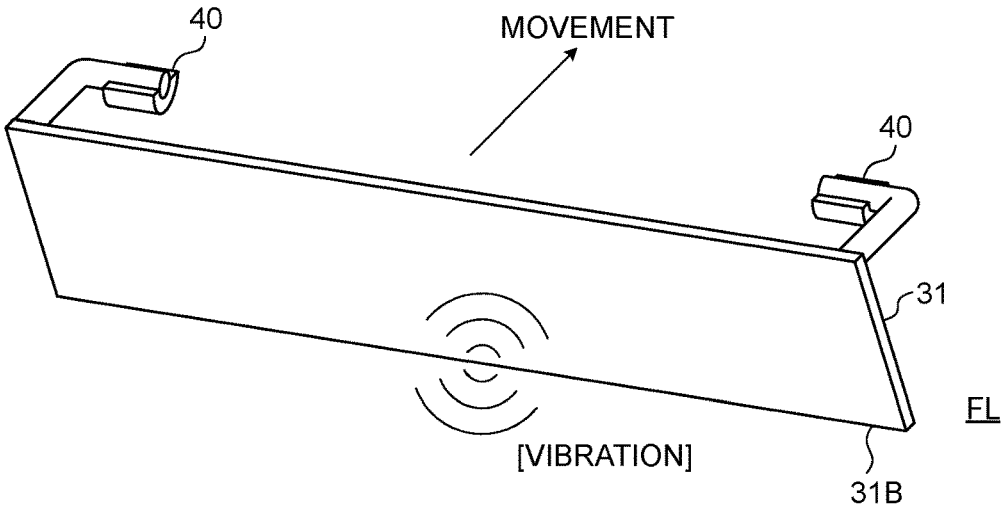
FIG. 17 illustrates operation of a biasing member according to the embodiment.
Figure 17:
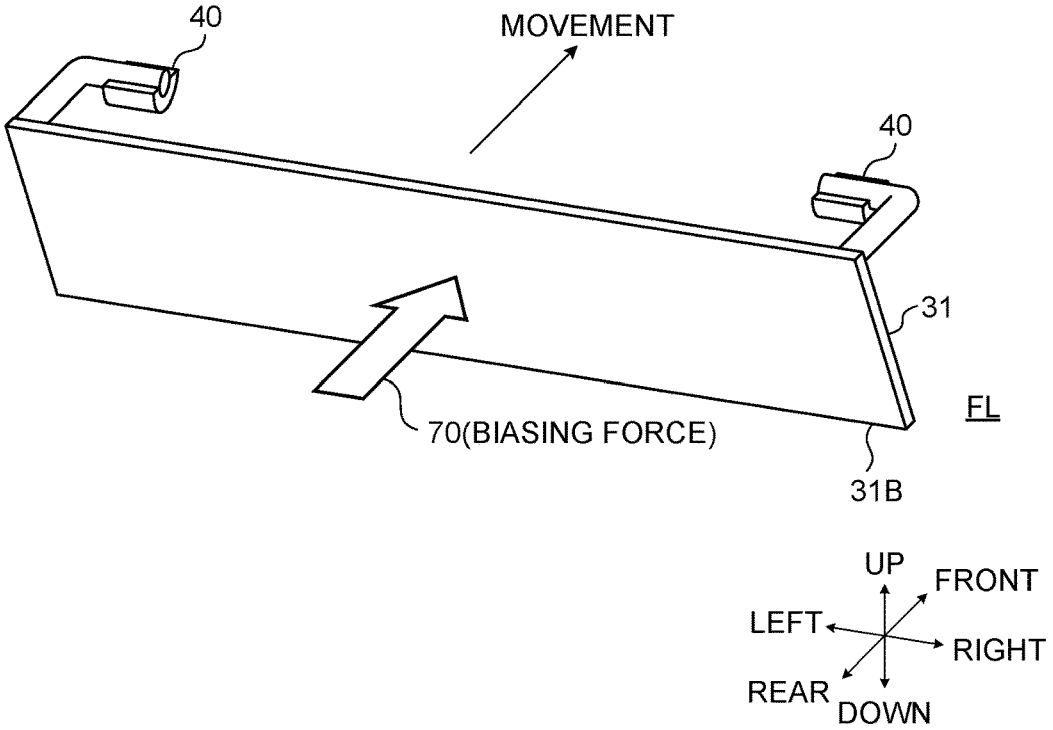

FIG. 17 illustrates operation of the biasing member 70 according to the embodiment. As described above, in cleaning operation on the cleaning target surface FL, the robotic dust collector 1 travels frontward with the lower end 31B of the blade part 31 facing the cleaning target surface FL. When the cleaning target surface FL is an irregular surface (uneven surface) such as a carpet surface, the blade part 31 may move frontward while the lower end 31B thereof being in contact with the cleaning target surface FL.

As illustrated in Comparative Example in FIG. 17, when the blade part 31 moves frontward with both ends of the blade part 31 supported by the support parts 40 and with the lower end 31B of the blade part 31 being in contact with the cleaning target surface FL, the surface of the blade part 31 may vibrate by repeatedly deforming in the front-rear direction. Self-excited vibration (chatter vibration) is an example of the vibration of the blade part 31. Noise may occur from the robotic dust collector 1 due to the vibration of the blade part 31.

As illustrated in Example in FIG. 17, in the embodiment, the blade part 31 moves while receiving biasing force from the biasing member 70 with both ends of the blade part 31 supported by the support parts 40. The biasing member 70 exerts biasing force on a surface of the blade part 31. With biasing force exerted on the surface of the blade part 31, the surface of the blade part 31 is prevented from deforming in the front-rear directions By having the blade part 31 prevented from deforming in the front-rear direction, the blade part 31 is prevented from vibrating. As a result, abnormal noise is prevented from occurring from the robotic dust collector 1.

Effects

As described above, according to the embodiment, when the robotic dust collector 1 travels with the blade part 31 facing the cleaning target surface FL, biasing force is applied to at least a part of the blade part 31 by the biasing member 70. Thus, the blade part 31 is prevented from vibrating even when the blade part 31 makes contact with the cleaning target surface FL. Therefore, abnormal noise is prevented from occurring from the robotic dust collector 1.

When the robotic dust collector 1 travels with the lower end 31B of the blade part 31 facing the cleaning target surface FL, the biasing member 70 exerts biasing force on a surface of the blade part 31 above the lower end 31B. The biasing member 70 exerts biasing force on the surface of the blade part 31 toward the front, that is, in the traveling direction of the robotic dust collector 1. This effectively prevents the surface of the blade part 31 from deforming in the front-rear direction when the blade part 31 makes contact with the cleaning target surface FL.

The elastic members 80 that bias the blade part 31 downward are provided. The lower end 31B of the blade part 31 is biased toward the cleaning target surface FL by the elastic force generated by the elastic members 80. Therefore, in the cleaning operation, the lower end 31B of the blade part 31 can continue to face the cleaning target surface FL. Therefore, the blade part 31 can properly collect dirt and dust from the cleaning target surface FL.

In the embodiment, both ends of the blade part 31 in the left-right direction are supported by the support parts 40. The deformation of a surface of the blade part 31 is likely to be greater in the central portion of the blade part 31 than both ends of the blade part 31 in the left-right direction. The biasing member 70 exerts biasing force on the central portion of the blade part 31. This effectively prevents the surface of the blade part 31 from deforming.

The support parts 40 are provided in the bottom plate 11D. This allows the structure of the robotic dust collector 1 to be less complex and smaller than otherwise.

When the robotic dust collector 1 travels frontward with the lower end 31B of the blade part 31 facing the cleaning target surface FL, the blade part 31 is disposed more rearward than the center of the suction inlet 18. This allows the blade part 31 to properly collect dirt and dust from the cleaning target surface FL.

The surface of the blade part 31 slopes downward toward the front, that is, in the traveling direction of the robotic dust collector 1. This allows the blade part 31 to properly collect dirt and dust from the cleaning target surface FL.

The biasing member 70 is disposed rearward of the blade part 31 and exerts biasing force on the rear surface of the blade part 31 toward the front. This provides appropriate biasing force to the blade part 31 in such a manner as to prevent the blade part 31 from vibrating. The biasing member 70 is disposed rearward of the blade part 31 and is not disposed at the suction inlet 18. As a result, it is possible to avoid the suction inlet 18 from having a smaller size.

The fixing member 60 that is fixed to the bottom plate 11D with the screws 90 is provided rearward of the blade part 31. The fixing member 60 is detachable from the bottom plate 11D. The biasing member 70 is provided on the fixing member 60. Because the fixing member 60 is detachable from the bottom plate 11D, the biasing member 70 is disposed rearward of the blade part 31 while having favorable assemblability. The fixing member 60 is detachable, whereby the biasing member 70 is easily replaced.

The pivot axis CX of the guide member 30 is disposed more forward than the blade part 31. In the embodiment, the pivot axis CX of the guide member 30 is disposed more forward than the suction inlet 18. This allows the guide member 30 to pivot smoothly while the robotic dust collector 1 travels.

The biasing member 70 includes: a first extending part 71 extending in the up-down direction; a second extending part 72 disposed more frontward than the first extending part 71 and configured to make contact with the rear surface of the blade part 31; and a bent part 73 connecting the lower end of the first extending part 71 and the lower end of the second extending part 72. The upper end of the first extending part 71 is apart from an upper end of the second extending part 72. The biasing member 70 elastically deforms in such a manner as to bring the upper end of the first extending part 71 and the upper end of the second extending part 72 close to and apart from each other. Therefore, even when the blade part 31 moves upward due to the pivoting of the guide member 30, the biasing member 70 can exert appropriate biasing force on the blade part 31.

The support parts 40 is disposed more frontward than the suction inlet 18. The guide member 30 has: arm parts 32 extending frontward from the blade part 31; and joint parts 33 connected to the arm parts 32 and supported by the support parts 40. The arm parts 32 connect the blade part 31 to the joint parts 33 without closing the suction inlet 18.

The lower face 32S of the arm part 32 between the lower end 32B of the arm part 32 and the corresponding joint part 33 is curved downward. This prevents resistance force acting on the arm part 32 from becoming excessively large when the lower face 32S makes contact with the cleaning target surface FL. Furthermore, when there are steps on the cleaning target surface FL, the arm part 32 is prevented from being caught on the steps. Thus, the robotic dust collector 1 can travel smoothly.

In the embodiment, the blade part 31 includes the flexible part 312 and the rib parts 313 connected to at least parts of the flexible part 312. The lower ends 313B of the rib parts 313 and the lower ends 32B of the arm parts 32 are disposed more downward than the lower end 312B of the flexible part 312. This allows the robotic dust collector 1 to smoothly travel. For example, if the lower end 312B of the flexible part 312 is disposed more downward than the lower ends 313B of the rib parts 313 and the lower ends 32B of the arm parts 32, the lower end 312B of the flexible part 312 may make contact with the cleaning target surface FL. If the robotic dust collector 1 travels with the lower end 312B of the flexible part 312 in contact with the cleaning target surface FL, the flexible part 312 may flex excessively and resistance force acting on the flexible part 312 may increase. If the flexible part 312 flexes excessively, the robotic dust collector 1 may have difficulty traveling smoothly. In the embodiment, the rib parts 313 and the arm parts 32 are made of synthetic resin and there is substantially no possibility of the rib parts 313 and the arm parts 32 flexing. The lower ends 313B of the rib parts 313 and the lower ends 32B of the arm parts 32 are disposed more downward than the lower end 312B of the flexible part 312, whereby the flexible part 312 does not flex excessively. The guide member 30 can move smoothly even when the lower ends 313B of the rib parts 313 or the lower ends 32B of the arm parts 32 make contact with the cleaning target surface FL. Thus, the robotic dust collector 1 can travel smoothly.

The rollers 50 that are rotatably supported by the arm parts 32 are provided. The lower ends 50B of the rollers 50 are disposed more downward than the lower ends 313B of the rib parts 313 and the lower ends 32B of the arm parts 32. The roller 50 can rotate about the rotation axis RX while being in contact with the cleaning target surface FL. This allows the robotic dust collector 1 to travel smoothly with the rollers 50 facing the cleaning target surface FL. The lower ends 50B of the rollers 50 are disposed more downward than the lower end 31B of the blade part 31 (lower ends 313B of the rib parts 313). This makes it less likely that the blade part 31 makes contact with the cleaning target surface FL when the cleaning target surface FL is a flat surface (even surface). This prevents the blade part 31 from vibrating by making contact with the cleaning target surface FL while the robotic dust collector 1 autonomously travels. Therefore, noise is prevented from occurring from the robotic dust collector 1. Similarly, the lower ends 50B of the rollers 50 are disposed more downward than the lower ends 32B of the arm parts 32. This prevents the arm parts 32 from vibrating by making contact with the cleaning target surface FL while the robotic dust collector 1 autonomously travels. Therefore, noise is prevented from occurring from the robotic dust collector 1.

Other Embodiments

In the embodiment described above, the support parts 40 are provided on the bottom plate 11D. The support parts 40 may be provided, for example, on the lower housing 11B.

In the embodiment described above, the biasing member 70 is integral with the fixing member 60 and made of synthetic resin. The biasing member 70 may be a separate body from the fixing member 60, or may be made of metal. The biasing member 70 may be, for example, a plate spring.

In the embodiment described above, the suction inlet 18 is provided in the bottom plate 11D. The bottom plate 11D may be eliminated. The suction inlet 18 may be disposed in the lower housing 11B. That is, the suction member may be the lower housing 11B.

In the embodiment described above, the robotic dust collector 1 moves frontward. The frontward direction with respect to the robotic dust collector 1 is a direction in which bumper 3 is located relative to the center of the robotic dust collector 1, and the rearward direction with respect to the robotic dust collector 1 is a direction in which the battery mounting parts 4 are located relative to the center of the robotic dust collector 1. The robotic dust collector 1 may travel in the rearward direction. When the robotic dust collector 1 travels in the rearward direction, the blade part 31 may be disposed frontward of the center of the suction inlet 18. The surface of the blade part 31 may slope downward toward the rear. The biasing member 70 may be disposed forward of the blade part 31 and exert biasing force on the blade part 31 toward the rear. The pivot axis CX of the guide member 30 may be disposed more rearward than the blade part 31 or more rearward than the suction inlet 18.

REFERENCE SIGNS LIST

1 ROBOTIC DUST COLLECTOR
2 BODY
2A TOP FACE
2B BOTTOM FACE
2C SIDE FACE
3 BUMPER
4 BATTERY MOUNTING PART
5 FAN UNIT
5A CASING
5B SUCTION FAN
5C SUCTION MOTOR
5D AIR INLET
5E AIR OUTLET
6 DUST BOX
6A BODY MEMBER
6B TRAY MEMBER
6C UPPER PLATE MEMBER
6D LOWER COLLECTION PORT

6E UPPER COLLECTION PORT
6F AIR OUTLET
6G FILTER
7 CASTER
8 ROLLER
9 WHEEL
10 WHEEL MOTOR
11 HOUSING
11A UPPER HOUSING
11B LOWER HOUSING
11C COVER PLATE
11D BOTTOM PLATE (SUCTION MEMBER)
12 TRAVELING DEVICE
13 MAIN BRUSH
13B BRUSH
13R ROD MEMBER
14 MAIN BRUSH MOTOR
15 SIDE BRUSH
15B BRUSH
15D DISK MEMBER
16 SIDE BRUSH MOTOR
17 HANDLE
18 SUCTION INLET
19 OBSTACLE SENSOR
20 INTERFACE DEVICE
20A POWER BUTTON
20B REMAINING POWER INDICATOR
30 GUIDE MEMBER
31 BLADE PART
31A UPPER END
31B LOWER END
31L LEFT END
31R RIGHT END
32 ARM PART
32B LOWER END
32L LEFT ARM PART
32LS SHAFT PART
32R RIGHT ARM PART
32RS SHAFT PART
32S LOWER FACE
33 JOINT PART
33L LEFT JOINT PART
33R RIGHT JOINT PART
311 BODY PART
312 FLEXIBLE PART
312B LOWER END
313 RIB PART
313B LOWER END
314 PROJECTION
315 RECESS
40 SUPPORT PART
40L LEFT SUPPORT PART
40R RIGHT SUPPORT PART
50 ROLLER
50B LOWER END
50L LEFT ROLLER
50R RIGHT ROLLER
60 FIXING MEMBER
61 OPENING
62 RECESS
70 BIASING MEMBER
71 FIRST EXTENDING PART
72 SECOND EXTENDING PART
73 BENT PART
80 ELASTIC MEMBER
90 SCREW
91 SCREW HOLE
100 CONTROLLER
AX ROTATION AXIS
BT BATTERY
CX PIVOT AXIS
FL CLEANING TARGET SURFACE
MX ROTATION AXIS
RX ROTATION AXIS
S STORAGE SPACE
S1 LOWER STORAGE SPACE
S2 UPPER STORAGE SPACE

The invention claimed is:

1. A robotic dust collector that includes a suction member having a suction inlet and travels on a cleaning target surface, the robotic dust collector comprising:

a guide member disposed at the suction inlet and having a blade part facing the cleaning target surface;

a support part supporting the guide member in such a manner that allows the guide member to pivot about a pivot axis so as to allow the blade part to move in an up-down direction; and a biasing member comprising a first extending part extending in a direction transverse to a traveling direction of the robotic dust collector, a second extending part extending transverse to the traveling direction and disposed frontward of the first extending part in the traveling direction, and a bent part connecting the first extending part to the second extending part, wherein the biasing member is disposed rearward of the blade part in the traveling direction of the robotic dust collector and configured to elastically deform such that an end of the first extending part and an end of the second extending part move towards and away from each other to bias a rear surface of the blade part forward in the traveling direction.

2. The robotic dust collector according to claim 1, wherein the biasing member is configured to bias a surface of the blade part in such a manner as to prevent deformation of the blade part caused by making contact with the cleaning target surface.

3. The robotic dust collector according to claim 1, further comprising an elastic member configured to bias the blade part downward.

4. The robotic dust collector according to claim 1, wherein both ends of the blade part are supported by the support part, and the biasing member is configured to bias a central portion of the blade part.

5. The robotic dust collector according to claim 1, wherein the support part is provided on the suction member.

6. The robotic dust collector according to claim 1, wherein the blade part is disposed more rearward than a center of the suction inlet.

7. The robotic dust collector according to claim 6, wherein a surface of the blade part slopes downward toward a front side.

8. The robotic dust collector according to claim 6, wherein the pivot axis is disposed more frontward than the blade part.

9. The robotic dust collector according to claim 8, wherein the pivot axis is disposed more frontward than the suction inlet.

10. The robotic dust collector according to claim 9, wherein the support part is disposed more frontward than the suction inlet, and the guide member includes an arm part and a joint part, the arm part extending frontward from the blade part, the joint part being connected to the arm part and supported by the support part.

11. The robotic dust collector according to claim 10, wherein a lower face of the arm part between a lower end of the arm part and the joint part is curved downward.

12. The robotic dust collector according to claim 11, wherein the blade part includes a flexible part, and a rib part connected to at least a part of the flexible part, and a lower end of the rib part and the lower end of the arm part are disposed more downward than a lower end of the flexible part.

13. The robotic dust collector according to claim 12, further comprising a roller rotatably supported by the arm part, wherein a lower end of the roller is disposed more downward than the lower end of the rib part and the lower end of the arm part.

14. The robotic dust collector according to claim 1, further comprising a fixing member disposed rearward of the blade part and detachable from the suction member, wherein the biasing member is provided in the fixing member.

* * * * *